US007682259B1

(12) United States Patent
Edwards

(10) Patent No.: US 7,682,259 B1
(45) Date of Patent: Mar. 23, 2010

(54) MODULAR AQUATIC ASSEMBLY FOR PROVIDING USER ENJOYMENT

(76) Inventor: Andrew Edwards, 5350 Beatle Court, Jacksonville, FL (US) 32244

( * ) Notice: Subject to any disclaimer, the term of this patent is extended or adjusted under 35 U.S.C. 154(b) by 615 days.

(21) Appl. No.: 11/640,413

(22) Filed: Dec. 18, 2006

Related U.S. Application Data

(63) Continuation-in-part of application No. 11/076,764, filed on Mar. 11, 2005, now abandoned.

(51) Int. Cl.
*A63G 21/18* (2006.01)
*A63G 21/00* (2006.01)

(52) U.S. Cl. ..... 472/117; 472/128

(58) Field of Classification Search ..... 472/116, 472/117, 128, 129, 13; 104/53, 69, 70
See application file for complete search history.

(56) References Cited

U.S. PATENT DOCUMENTS 4,196,900 A * 4/1980 Becker et al. ..... 472/117
4,429,867 A * 2/1984 Barber ..... 472/13
5,154,671 A * 10/1992 Smollar et al. ..... 472/117
5,421,782 A * 6/1995 Lochtefeld ..... 472/117
5,433,671 A * 7/1995 Davis ..... 472/117
5,507,696 A * 4/1996 Smollar et al. ..... 472/117
5,772,535 A * 6/1998 Murphy ..... 473/415
5,820,471 A * 10/1998 Briggs ..... 472/128
6,062,983 A * 5/2000 Butsook ..... 472/117
6,261,186 B1 * 7/2001 Henry ..... 472/128
6,342,016 B1 * 1/2002 Parker ..... 472/128
6,527,646 B1 * 3/2003 Briggs ..... 472/117
6,743,108 B2 * 6/2004 Hunter ..... 472/117
6,758,231 B1 * 7/2004 Lochtefeld et al. ..... 137/1
6,832,786 B2 * 12/2004 Duncan et al. ..... 285/23

* cited by examiner

*Primary Examiner*—Kien T Nguyen

(57) ABSTRACT

The water park assembly includes a plurality of couplings with fittings for connection with an external water system. A box is matable with a waterline for connecting a thru-wall skimmer thereto, and an outlet is formed within one of the couplings. Fittings are formed within an inner wall of the coupling, and water jet nozzles are anchored thereto. Light illuminating sources are anchored within the fittings. Selected couplings have a handle attached thereto. At least one wheel is connected to an associated one of the couplings. Each of the couplings includes holes for anchoring coupling arches. The ends of the couplings have vertical grooves and attachment holes formed therein for receiving supports, wheels, handles and waterfall decorations. A slot is formed in the couplings for a rupture gate. The gate includes cross bars supporting the gate to an associated one of the couplings.

13 Claims, 27 Drawing Sheets

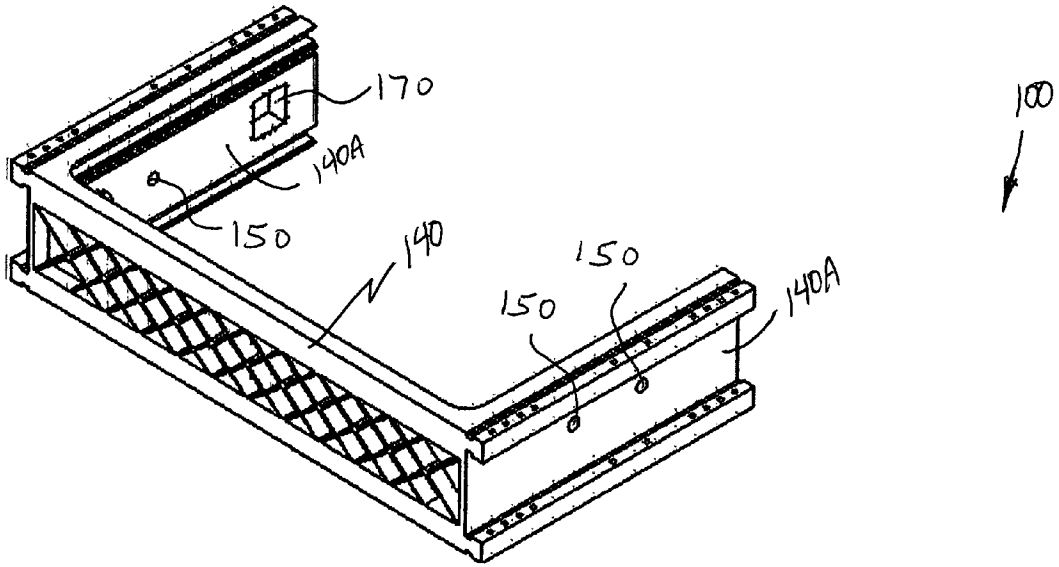
FIG. 18
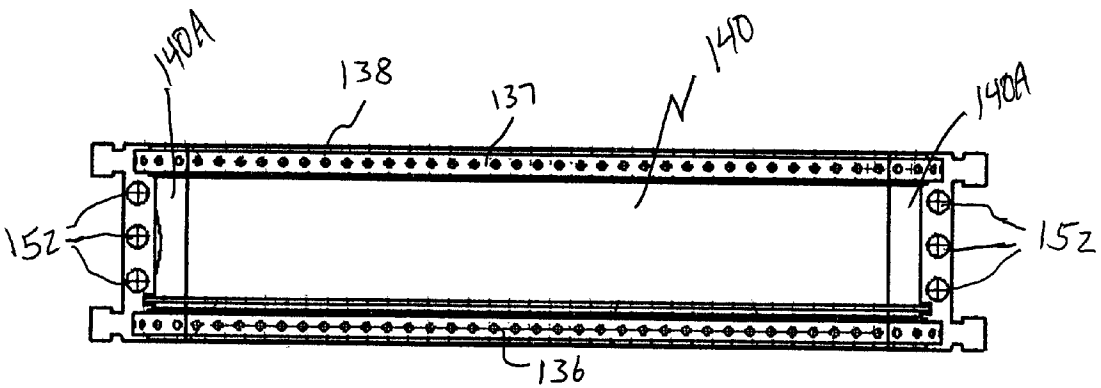

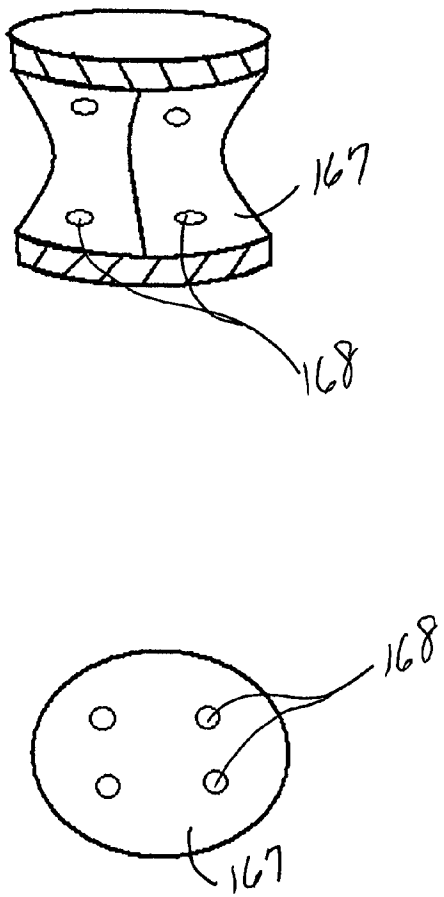
FIG. 32
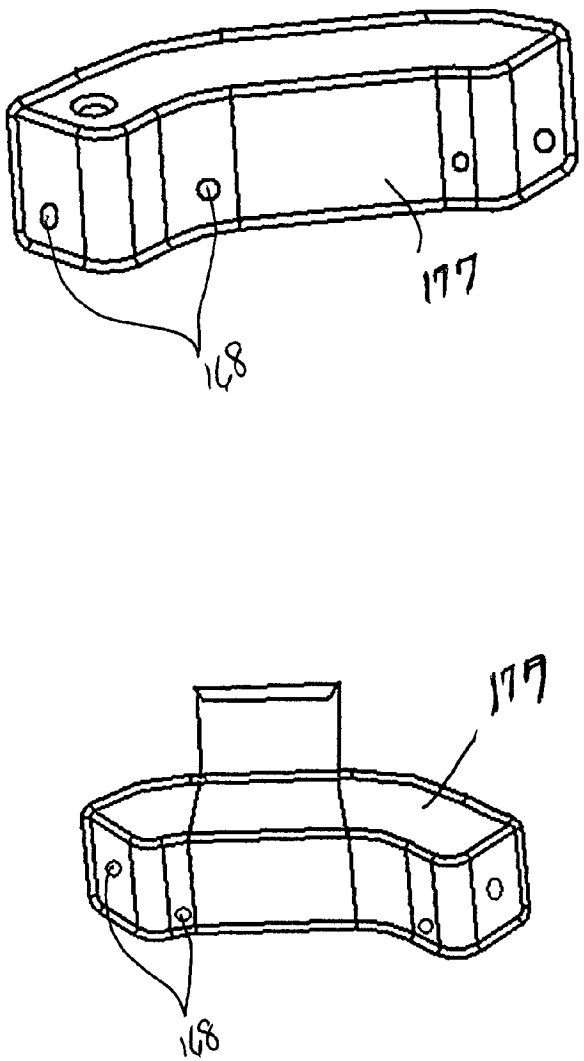

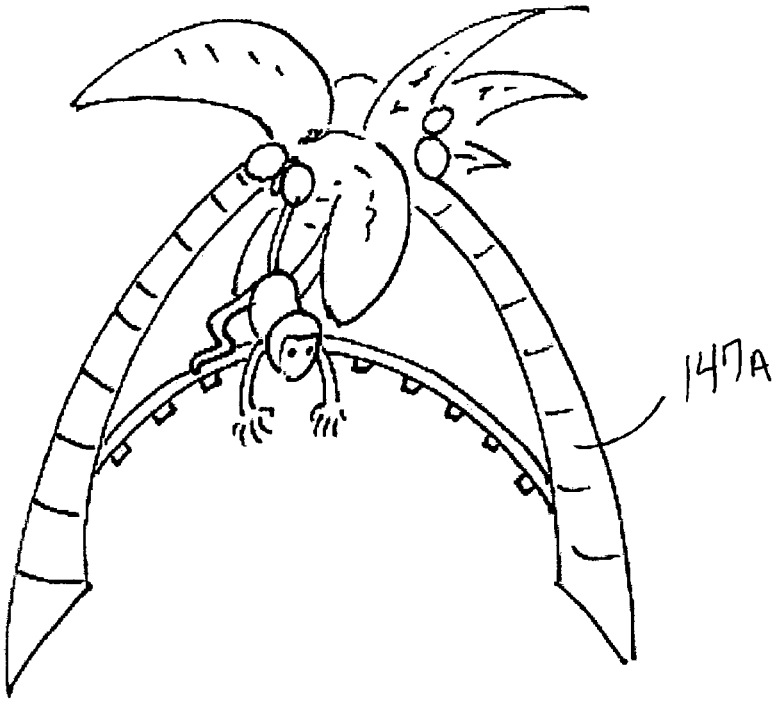
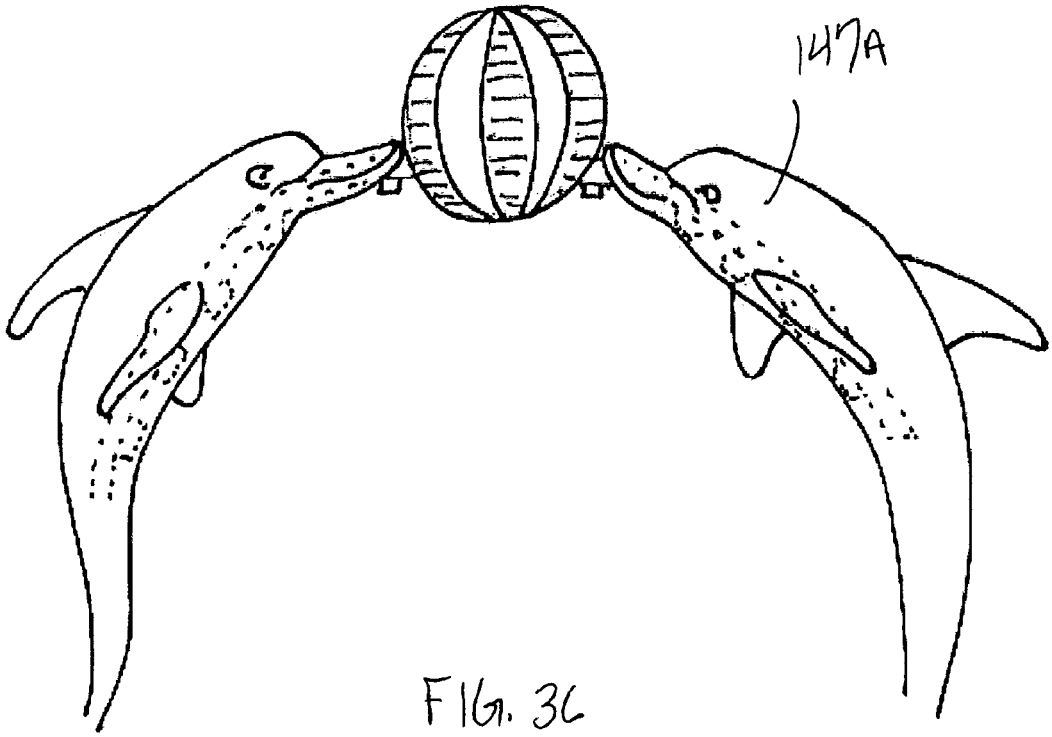
FIG. 3C

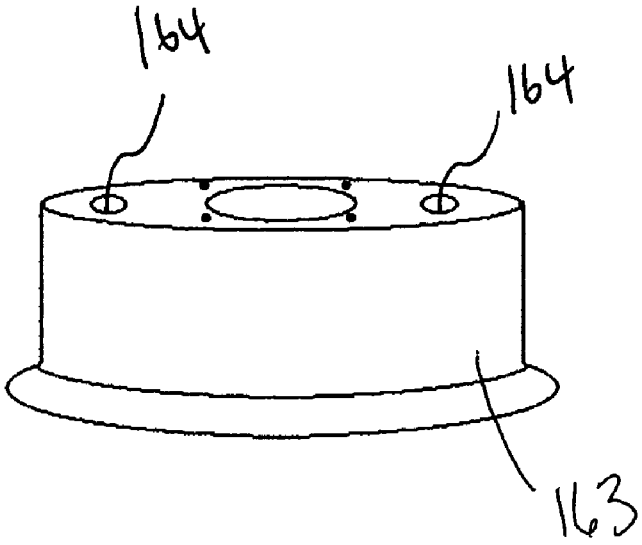
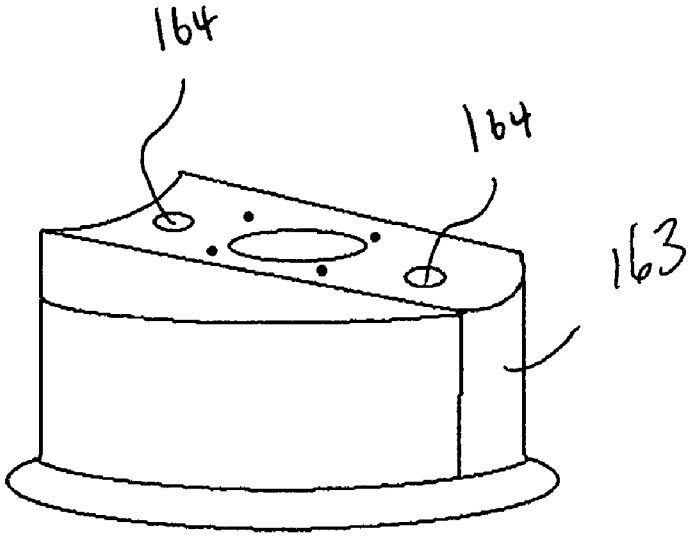
FIG. 37

MODULAR AQUATIC ASSEMBLY FOR PROVIDING USER ENJOYMENT

CROSS REFERENCE TO RELATED APPLICATIONS

This is a continuation-in-part application of U.S. patent application Ser. No. 11/076,764, filed on Mar. 11, 2005 now abandoned, the entire disclosure of which is incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to water park amusement rides and, more particularly, to a modular aquatic assembly for providing user enjoyment that can be easily disassembled and transported to a remote location.

2. Prior Art

Water slides have come into recent vogue, particularly in the seashore resort areas where as a diversion to swimming in the ocean and riding the surf, the bather can ride flexible mats along predetermined shallow water flow paths as defined by flumes which carry water from a starting pool at some given vertical elevation to a landing pool displaced therefrom and at a lower elevation.

Either natural water is supplied at the upper end of the starting pool and discharged at the landing pool or pumps are provided for continuously circulating the water from the landing pool to the starting pools for gravity traverse down the flumes and subsequent return for collection at the landing pool. Typically, a water trough is provided from a high elevation to a lower elevation, with turns and sharp drops in elevation provided. Water is pumped up to the top of the trough and allowed to fall under the influence of gravity to the bottom of the trough.

Passenger carrying boats are often elevated from a passenger loading platform to the top of the trough and then allowed to be carried by the falling water to the bottom of the trough. The turns and drops in elevation give a thrilling ride for the passengers. Such rides have been in use for a number of years and are permanently installed in a number of large amusement parks. Such rides are generally permanent installations of welded steel reinforced water flume sections. The starting and landing pools and the intervening flumes have often been constructed of reinforced concrete and embedded in natural or prepared earth formations. The reinforced concrete provides particular problems with respect to climactic changes giving problems due to expansion and contraction. The water rides, once created, are virtually impossible to move. The surface of the concrete readily abrades the skin of the users of the water slide, and in some cases, presents esthetic problems.

Attempts have been made to construct water slides consisting of one or more flumes mounted on an open wooden or metal framework and in which case the flumes being made of sheet metal or laid up fiberglass provide a surface which is sufficiently smooth to permit the mat carrying the user to move with little friction, particularly with the water over the course of the flumes. Again, such structures are limited in their esthetics, are fixed in terms of the curvature or path taken by the flumes, are extensive and once assembled, and again, are virtually impossible to dismantle for reconstruction on a different site.

As a result, such rides are expensive to build and difficult to relocate. Therefore, it would be advantageous to provide a water flume ride construction of lower costs, with trough sections of lighter weight that are easier to assemble, and which can be readily disassembled for movement to a different site.

Accordingly, a need remains for a water amusement ride that is easy to assemble and disassemble, and can be easily transported to a different site as desired by a user. The present invention satisfies such a need by providing a modular aquatic assembly that features uniquely shaped modular units that can be readily assembled and disassembled at an economical cost. Such units are also readily transportable so that a user may place it in a northern climate in the summer season, and then disassemble it and move it to a southern climate during the winter season, for example. Such an assembly ensures that an owner reaps the maximum benefit from the assembly without incurring exorbitant costs.

BRIEF SUMMARY OF THE INVENTION

In view of the foregoing background, it is therefore an object of the present invention to provide a portable water ride assembly for simulating a lazy river. These and other objects, features, and advantages of the invention are provided by an assembly including a plurality of uniquely dimensioned modular units securely conjoinable for defining a predetermined travel path along which a selected volume of water can be directed. Such modular units include a plurality of annular couplings having corresponding sizes and shapes for mating during operating conditions and providing a water-tight seal along which the water may travel for generating a current. Selected ones of the couplings define male members and alternate ones of the couplings define female members threadably engageable with the male members such that the modular units can be removably engaged as needed during non-operating procedures. Each annular coupling has a diameter greater than a diameter of the modular units respectively.

The assembly further includes a plurality of reinforcing banks formed from durable material and outwardly situated about an outer surface of each of the modular units such that the banks resist operating forces exerted outwardly and away from the travel path during operating conditions. Each bank is selectively inflatable for receiving a predetermined quantity of air in such a manner that the banks provide buoyant support about the outer surfaces of the modular units and maintain the primary modular units at substantially stable and static positions during operating conditions. Each bank includes a rigid support member having an arcuate top surface and a planar bottom surface sized and shaped for receiving a portion of the modular units such that the modular units can be maintained at an elevated position above a ground surface during operating conditions.

The assembly further includes a mechanism for preventing water from flowing beyond at least one of the modular units. The water preventing mechanism includes at least one spring-actuated gate transversely slidable adjacent a corresponding one of the couplings in such a manner that the spring-actuated gate intersects water flowing beneath the corresponding coupling while maintaining an open path between a top edge of the spring-actuated gate and a top edge of the coupling respectively. Such a spring-actuated gate has a serrated bottom edge portion.

The water preventing mechanism further includes a selectively rotatable drive gear operably engaged with the serrated bottom edge portion in such a manner that the spring-actuated gate can be positioned along a horizontal and linear path as the drive gear of the water preventing mechanism is rotated along an arcuate path.

The assembly further includes a mechanism for selectively rotating the couplings along clockwise and counter clockwise radial paths for simulating predetermined decorative themes which provide user enjoyment during transit along the travel path. Such a rotating mechanism includes a plurality of portable housings and a plurality of power operable motors seated therein respectively. Such power motors are also manually operable. Each motor is removably attachable to an associated one of the couplings respectively. Each motor includes a drive gear operably connected thereto wherein each drive gear is operably conjoinable to a selected portion of one of the couplings respectively.

A plurality of annular sprockets are centered about an outer surface of the couplings and are independently operable from the male and female sections respectively. Each coupling further includes concentrically spaced inner and outer layers registered about the travel path for defining a cavity and a plurality of annular bearings nested within the cavity and extending about the perimeter of the couplings wherein the bearings are intercalated between the sprockets and the inner layers so that the outer layers of the couplings can independently rotate while the inner layers remain at static positions. The cavities are provided with an interior protective layer nested therein for contacting the bearings and cooperating therewith during rotating conditions.

Selected ones of the couplings are preferably provided with spray jets in fluid communication with an external water supply source for discharging a predetermined volume of water onto the users and selected ones of the couplings include a plurality of slots formed therein.

The assembly preferably further includes decorative attachments illustrating predetermined themes and provided with at least one protrusion detachably lockable into an associated one of the slots in such a manner that the attachments can be maintained at a substantially stable position about at least one of the couplings while rotating in sync therewith during rotating conditions.

The assembly further includes a pool, a lazy river in fluid communication with the pool, a waterslide in fluid communication with one of the pool and the lazy river, an interactive spray ground in fluid communication with one of the waterslide and the lazy river and the pool, a cave operably positioned along the lazy river, a tunnel operably positioned along the lazy river, a waterfall in fluid communication with one of the pool and the lazy river and the waterslide and the spray ground, a rapids stream in fluid communication with one of the pool and the lazy river and the waterslide and the spray ground and the waterfall, and a plurality of detachable modular segments joined together using a plurality of coupling devices for providing a water tight connection between the modular segments.

The couplings include a plurality of fittings for conveniently receiving plumbing connections and for effectively facilitating connections with an existing external water filtration and circulation systems. A box is matable with a waterline for connecting a thru-wall skimmer thereto. An outlet is formed within one of the couplings for returning water from the filtration and circulation systems. A plurality of fittings is advantageously formed within an inner wall of the coupling, and a plurality of water jet nozzles is anchored to the fittings for effectively providing a current direction to the lazy river. A plurality of light illuminating sources is anchored within the fittings. Selected ones of the couplings further include at least one coupling handle advantageously attached thereto. At least one coupling wheel is connected to an associated one of the couplings for conveniently transporting the couplings.

Each of the couplings further includes a plurality of holes for effectively anchoring a plurality of coupling arches. The outer most ends of the couplings have vertical grooves and attachment holes formed therein respectively for conveniently receiving a plurality of supports and a plurality of wheels and a plurality of handles and a plurality of waterfall decorations respectively. A slot is formed therein for receiving a rupture gate. Such a rupture gate includes a plurality of cross bars supporting the rupture gate to an associated one of the couplings respectively.

The coupling arches have semi-circular shapes and are attached to associated ones of the couplings. Such coupling arches are outfitted with at least one accessories selected from a group including the water jets and a coconut tree and a dolphin and the light illuminating sources and an outdoor speaker respectively.

The modular segments include a plurality of inflatable banks effectively supported by a plurality of metal supports that advantageously resist outward forces of the water and keep the inflatable banks of the assembly erect. A flexible padded flooring has a liner operably connected thereto, and juxtaposed ones of the inflatable banks are separated by the padded flooring. Each of the modular segments is conveniently provided with a plurality of inflation valves associated with a corresponding one of each of the inflatable banks respectively. Each of such inflation valves is in fluid connection via an associated air tube that effectively extends through the inclined surface of the coupling pads respectively for allowing a user to simultaneously inflate the inflatable banks via one of the associated inflation valves respectively. Such metal supports symmetrically extend along a curvature of associated ones of the modular segments and are attached to associated ones of the coupling segments respectively.

One end of each of the modular segments further includes a first rubber gasket that has spaced holes formed therein. Such gaskets are abutted against the couplings for providing a watertight seal. Each of such couplings includes a plurality of grooves formed on both sides of respectively inner walls thereof, and a second gasket is positioned about the grooves. A plurality of third gaskets is lined along an upper and outermost perimeter of the groove for providing a watertight seal between the couplings and the modular segments respectively.

The modular segments further include a plurality of brackets directly attached to the first gaskets respectively such that the first gaskets are fixedly secured to the coupling during operating conditions. Such brackets include a plurality of vertical securing brackets and a plurality of corner securing brackets and a horizontal base securing bracket coupled to each of the modular segments respectively. Selected ones of the brackets conveniently include a decorative covering for effectively shielding the selected brackets from a visible line of sight. Such a decorative covering is advantageously affixed to an associated one of the inflatable banks of the modular segments via a fastener. The decorative covering is selectively inflatable along the inflatable banks of the assembly.

The modular segments further include a coupling pad located behind the first gasket. Such a coupling pad has an inclined surface that effectively smoothes out a plane disposed between one of the modular segments and an associated one of the couplings respectively. Each coupling pad covers a corresponding one of the base securing brackets and is fixedly maintained by a plurality of suction cups removably affixed to a center surface of the coupling. The waterslide includes a hydraulically operated water slide platform. Each of the slide platforms is effectively secured to a back of a flat bed trailer for advantageously varying a height of the platforms. A plurality of out riggers is operably coupled to the platforms for conveniently assisting an operator to adjust the height of the platforms. A plurality of anchor platforms effectively supports a bottom end of the waterslide in the pool. Each of such anchor platforms conveniently includes a plurality of cavities filled with a predetermined volume of weighted products for effectively maintaining the anchor platforms statically engaged with a base of the pool. At least one bench is seated within the pool. Such an at least one bench includes at least one of the air jets, and a patio umbrella attached thereto. At least one ladder is spaced along the assembly for advantageously allowing a user easy ingress and egress from the water park and further allowing a user to conveniently access the waterslides disposed throughout the water park.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 18 is a top plan and perspective view of a coupling as viewed from the base of the coupling;

FIG. 32 is a perspective view of a pool bench and pool stool respectively;

FIG. 36 is a perspective view of coupling decorations; and

FIG. 37 is a perspective view of an anchor platform.

DETAILED DESCRIPTION OF THE INVENTION

Figure 11:
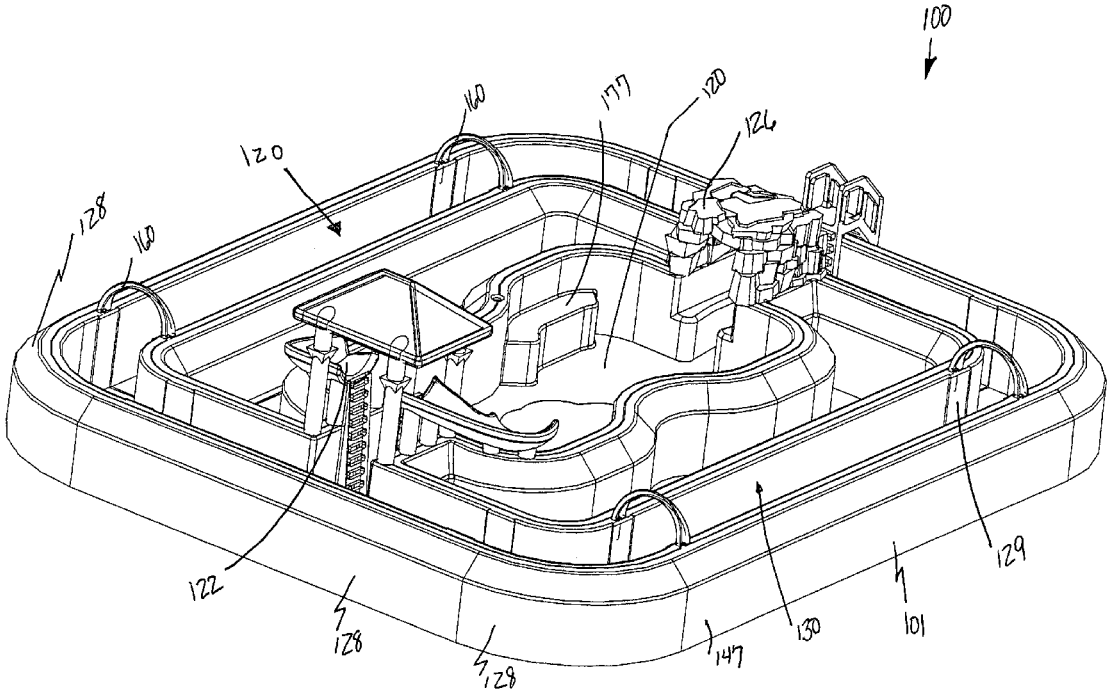
FIG. 11 is a perspective view of a modular aquatic assembly, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures. The entire disclosure of U.S. patent application Ser. No. 11/076,764 is incorporated herein by reference.

Now referring to the new embodiments and initially FIGS. 11, 14, 15, 17, 18, 20, 26, 34 and 35, the assembly 100 is a portable water park 101 that can be setup virtually anywhere space is available. It includes multiple pools 120, a lazy river 121, waterslides 122, interactive spray grounds 123, caves 124, spray tunnels 125, waterfalls 126, rapids 127 and many more amenities. Of course, many different types of amenities may be used, as is obvious to a person of ordinary skill in the art. The water park 101 is divided into modular segments 128, which is essential for easy assembly, disassembly and transportation. These modular segments 128 are joined together using a coupling device 129 that provides a water tight connection between segments 128. The banks 130 of the modular segments 128 are inflatable and can be of various shapes and designs, as is obvious to a person of ordinary skill in the art. The banks 130 are supported by metal supports 131 that resist the outward forces of the water and keep the banks 130 of the assembly 100 erect.

Referring to FIGS. 14, 16, 17 and 18, the water park 101 is divided into modular segments 128. Each modular segment 128 consists of inflatable banks 130, metal supports 131, flexible padded flooring 132, liner 133 and coupling pads 199. These are the basic units that make up the modular segments 128. The couplings 129 are used to connect these modular segments 128 together. Modular segments 128 can be of various sizes, shapes, or designs, as is obvious to a person of ordinary skill in the art. Regardless of their sizes or designs, all modular segments 128 advantageously connect to each other in same manner.

Referring to FIGS. 16, 17, 18, 19 and 20, the end of each modular segment 128 is a rubber gasket 134 with evenly spaced holes 135. This gasket 134 is called the liner gasket 134. The length and width of this gasket 134 is the same as the inner dimensions of the rigid plastic couplings 129, which is essential for providing a watertight seal. These couplings 129 have two (3"×2") grooves 136 on both sides of their inner walls. At the bottom of each groove 136 is a rubber gasket 137 that has matching screw holes 138 and is permanently attached to the coupling 129. Another set of gaskets 139 also line the upper and outermost perimeter of this groove 136. These gaskets 139 help to provide a watertight seal between the couplings 129 and the modular segments 128. The liner gaskets 134 of the modular segments 128 are designed to fit snuggly into the grooves 136 of the coupling 129. The liner gasket 134 is inserted in a manner that allows the holes 135 of the liner gasket 134 to align with the gasket holes 138 of the couplings 129. The liner gasket 134 is then secured to the coupling 129 with securing brackets 140. Bolt cavity 307 is predrilled into inner walls of the grooves 129 for receiving a fastener therethrough.

Again referring to FIGS. 16, 17, 19 and 20, these are rigid plastic brackets 140 used to provide a constant pressure between the coupling 129 and the gaskets 134 and 139, which is critical to provide a watertight connection. These brackets 140 have screw holes 141 that also align with both the screw holes 135, 138 of the liner gasket 134 and the coupling 129. There are 2 vertical securing brackets 140A, 2 corner securing brackets 140B, and 1 horizontal base securing bracket 140C. The brackets 140 are fastened by the use of heavy duty bolts. Of course, such brackets 140 can be formed from a variety of materials, as is obvious to a person of ordinary skill in the art. The bottom surface of the brackets 140 may be formed from non-corrosive material having a hollow mesh pattern for effectively reducing the weight of the bracket 140 without reducing the strength thereof.

Figure 16:
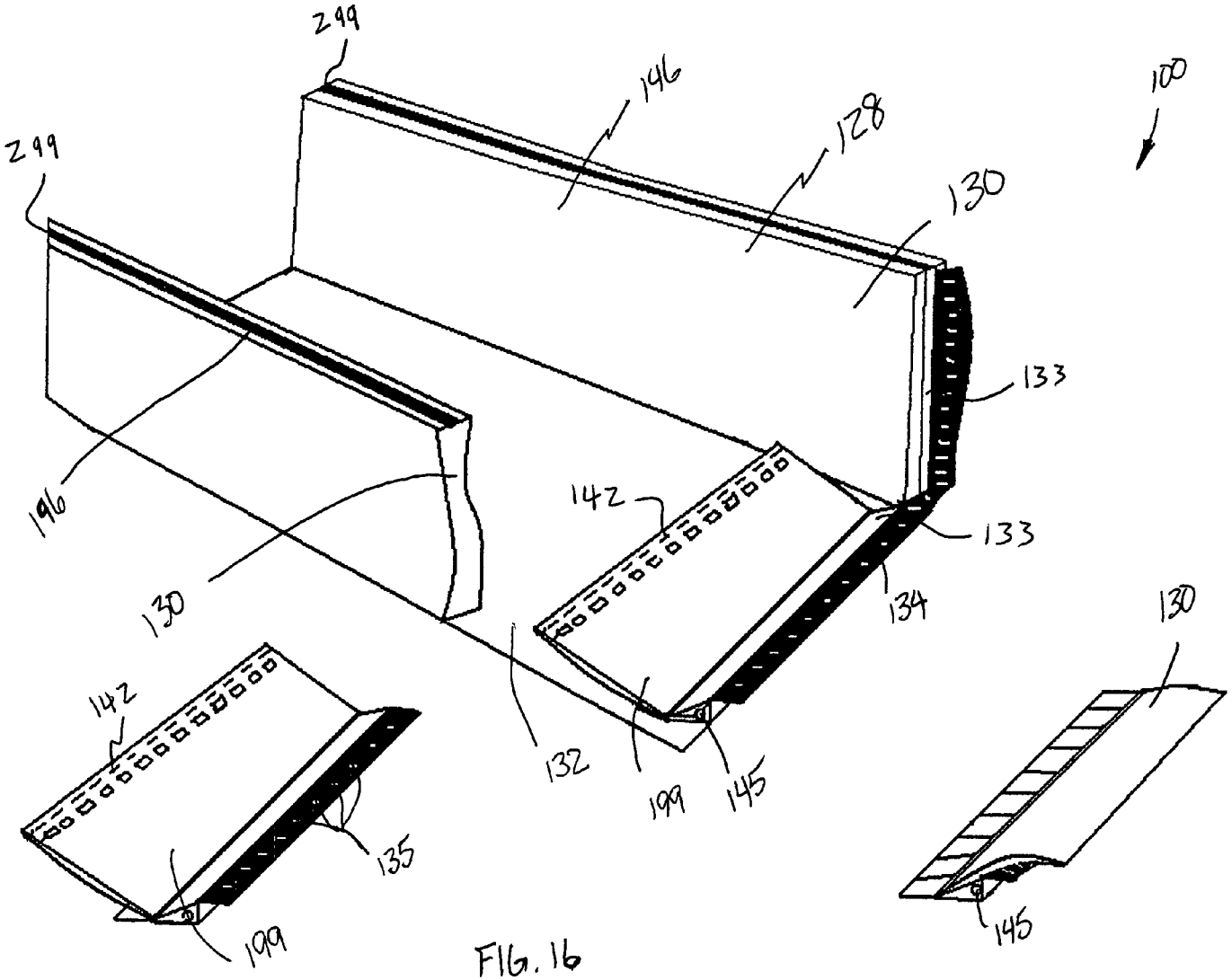
FIG. 16 is a perspective view showing the pool floor and inflatable banks.
Figure 17:
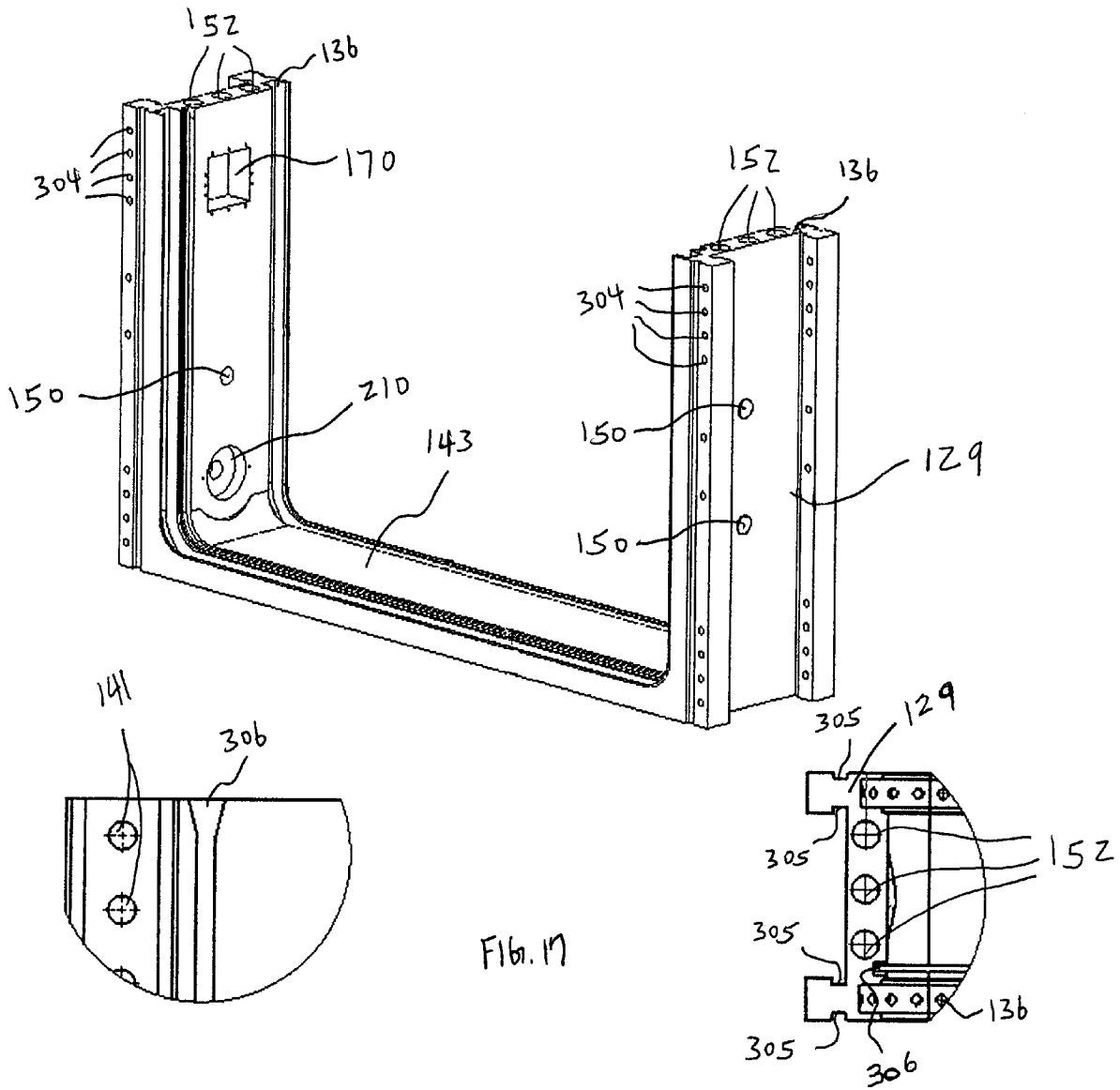
FIG. 17 is a perspective view of a coupling.
Figure 19:
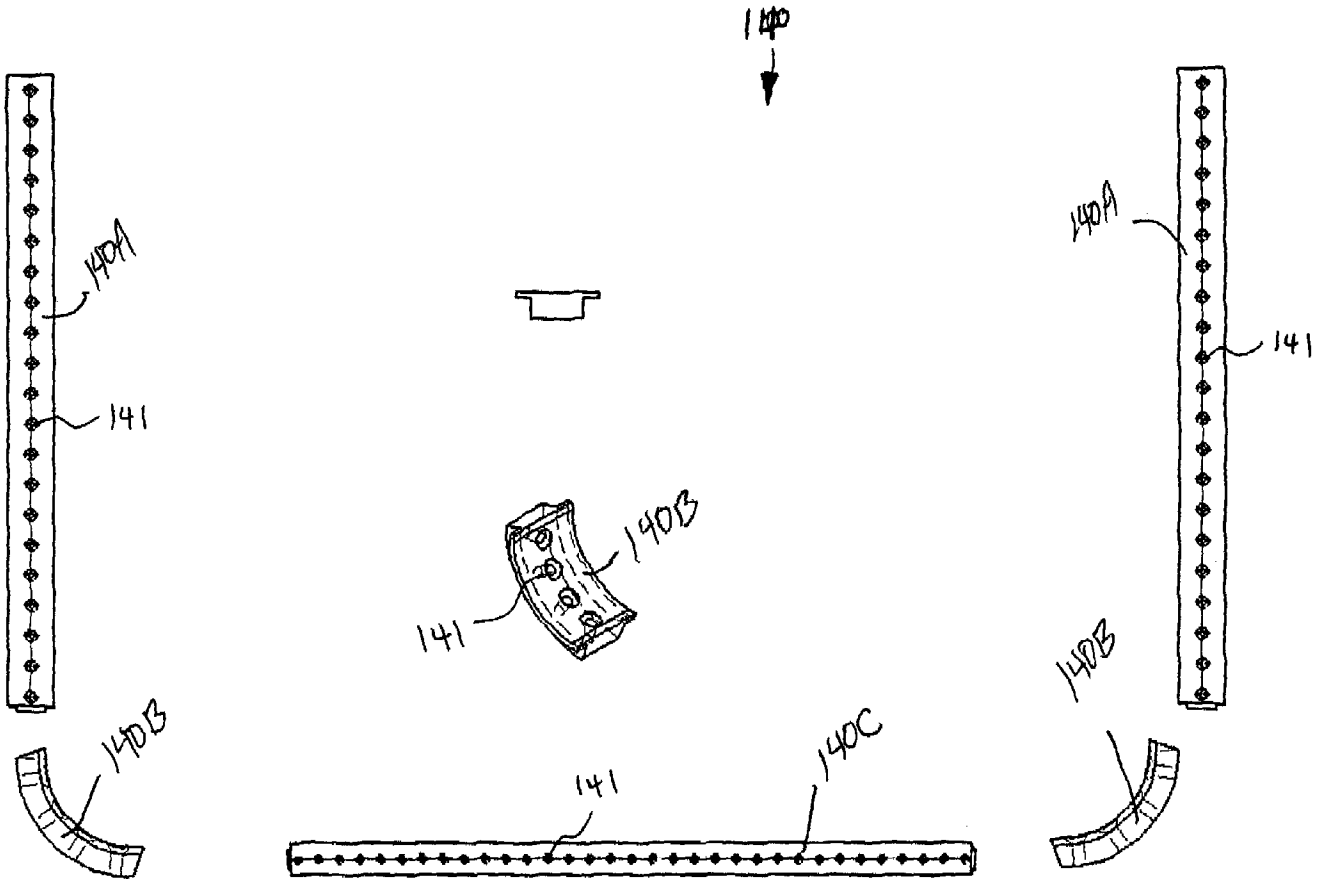
FIG. 19 is a side elevational view of the vertical securing brackets, the curved securing brackets and the base securing brackets respectively.
Figure 20:
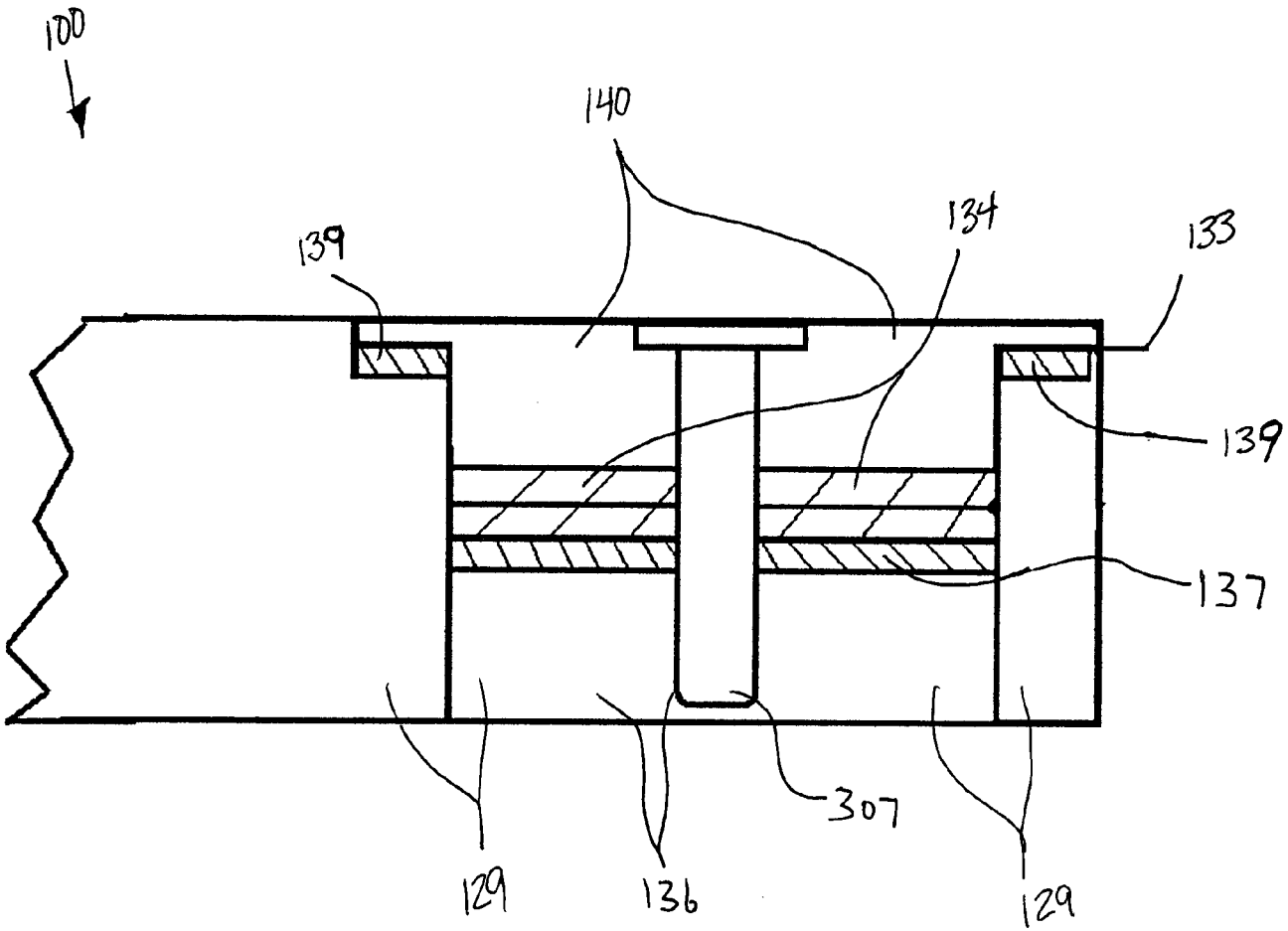
FIG. 20 is a partial cross sectional view of couplings joined together with the liner gasket.

Referring to FIGS. 16 and 17, each modular segment 128 is outfitted with a coupling pad 199 located just behind the liner gasket 134, which is vital for protecting patrons from injuring themselves on the couplings 129. Coupling pads 199 have a gradual incline that smoothes out the plane between the modular segments 128 and the coupling 129. The pads 199 cover the base securing brackets 140C and are held in place by small suction cups 142 (similar to that of a bath mat) that affix to the center surface of the coupling floors 143. This process is repeated for all successive segments 128 until all segments 128 are connected.

Figure 14:
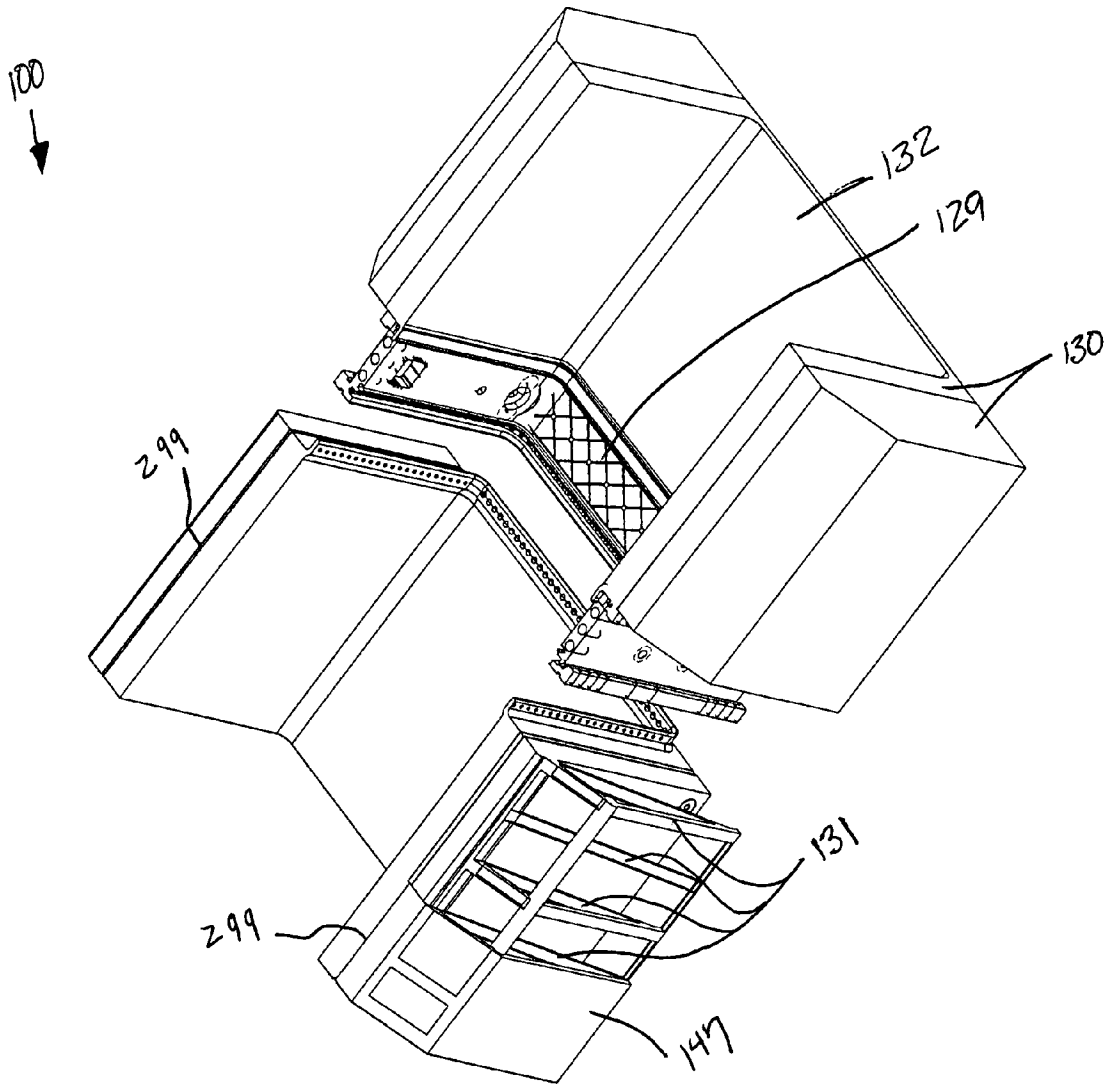
FIG. 14 is a perspective view of the metal supports.
Figure 15:
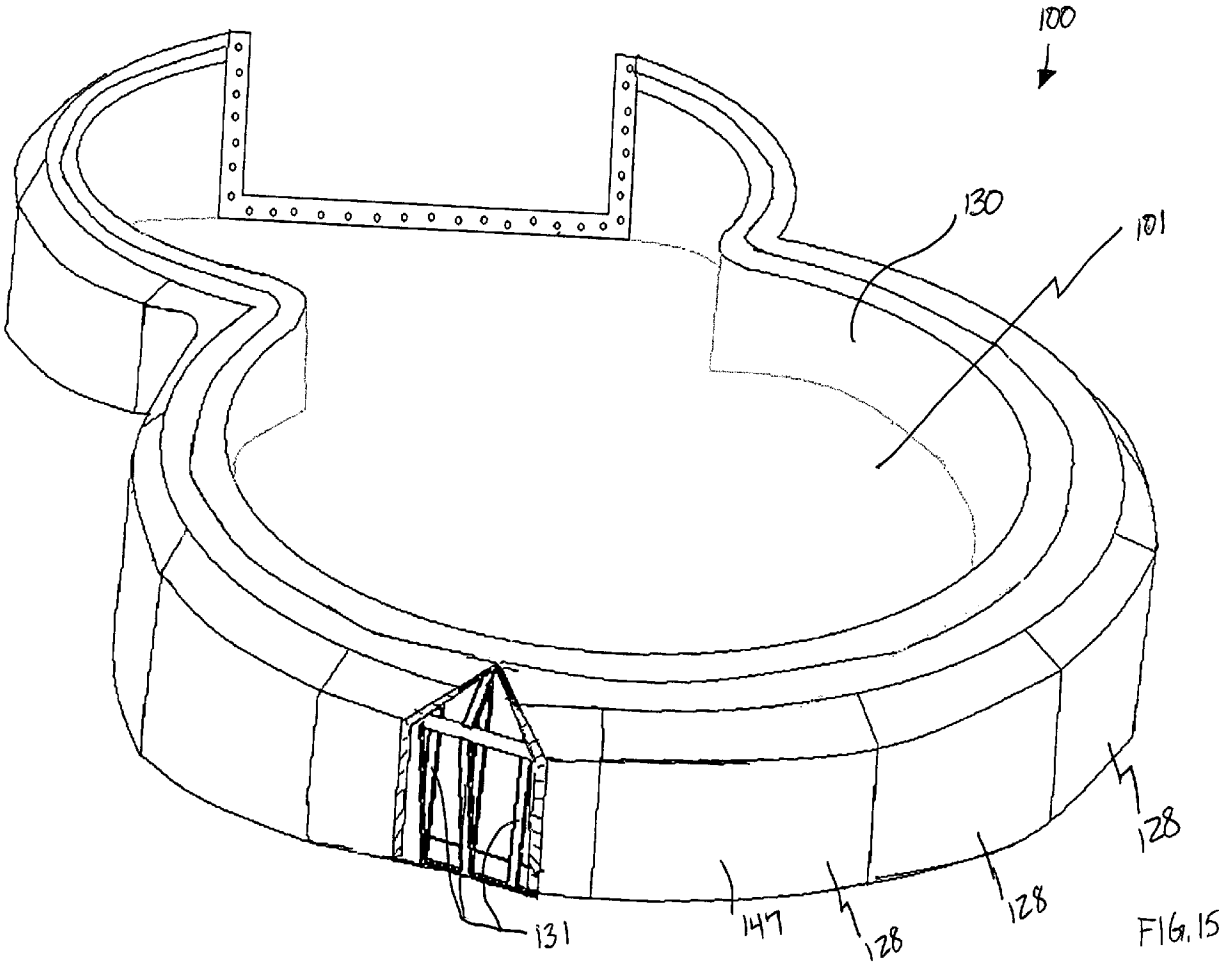
FIG. 15 is a perspective view of the pool.

Referring to FIGS. 14 and 16, the banks 130 of each modular segment 128 are inflatable to an extent that it advantageously provides the banks 130 with a distinct shape and offers a protective cushioning for patrons. Such inflatable banks 130 are separated by a padded non inflatable flooring 132. There are two inflation valves for each modular segment 128, one for each bank 130. However, the inflation valves are connected to each other by an air tube 145 that runs through the inclined section of the coupling pad 199, which is important such that both wall segments 146 can be inflated simultaneously by using only one inflation valve. This helps to reduce setup time.

Again referring to FIGS. 14 and 16, once the banks 130 are inflated, they are supported and kept erect using various metal supports 131 that are designed to match the shapes of the modular segments 128. The shapes of these metal supports 131 will match the curvature and shapes of the modular segments 128. Metal supports 131 are also attached to coupling segments 129, which is essential to provide greater stability (optional). Of course, such supports 131 can be formed from a variety of suitable materials, as is obvious to a person of ordinary skill in the art.

Again referring to FIGS. 16 and 19, once all the metal supports 131 are in place, the couplings 129 are covered with a decorative covering 147 for aesthetic purposes. This decorative covering 147 is affixed to the inflatable section of the modular segment 128 by using a heavy duty zipper 299. The decorative covering 147 conceals the metal supports 131 all the way to the ground. This covering 147 inflates by 2 inches, which is critical so that it provides a uniformly smoothed appearance (without kinks and creases) along the banks 130 of the water park 101.

Figure 21:
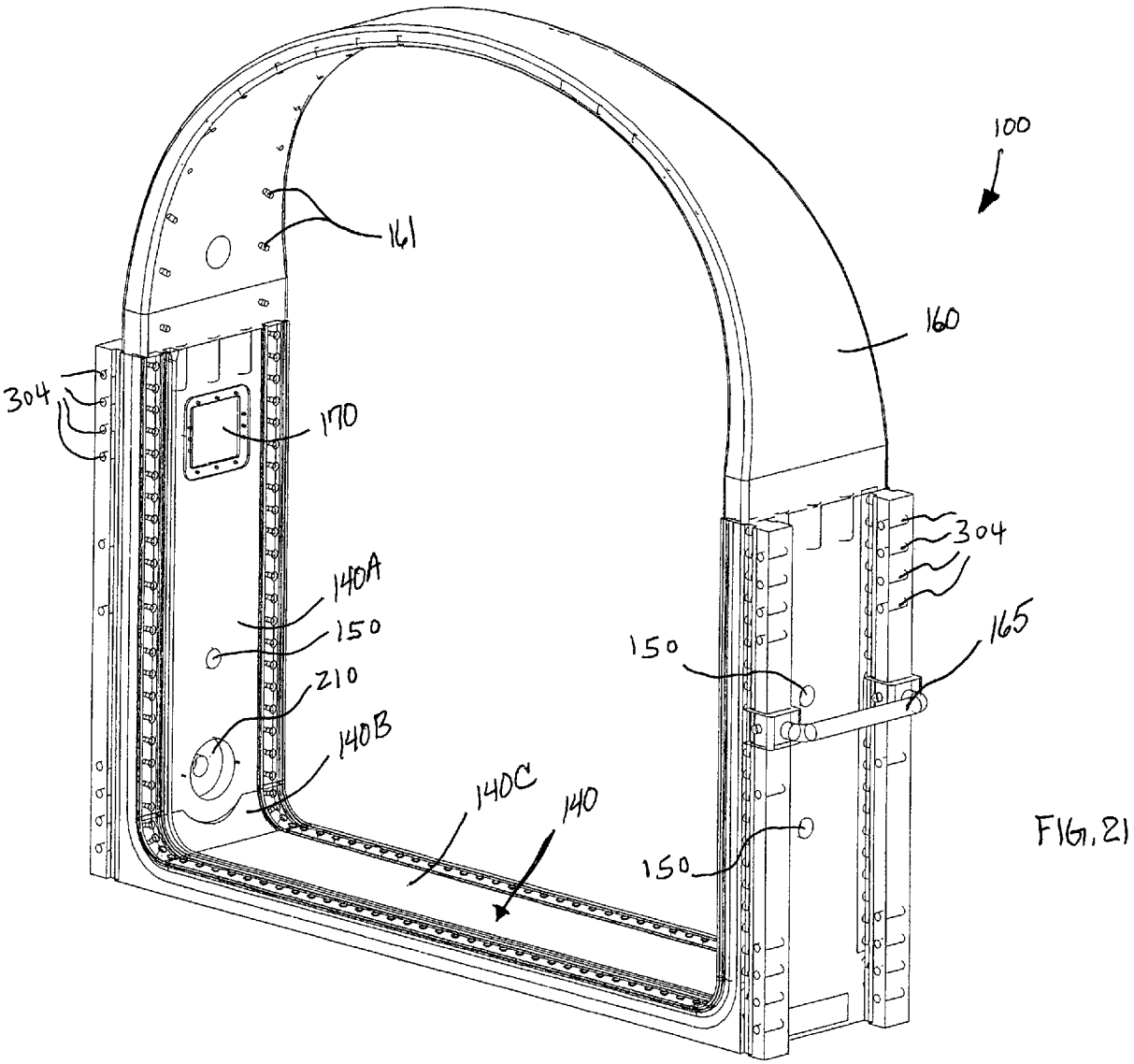
FIG. 21 is a perspective view of a coupling arch and couplings joined together.
Figure 22:
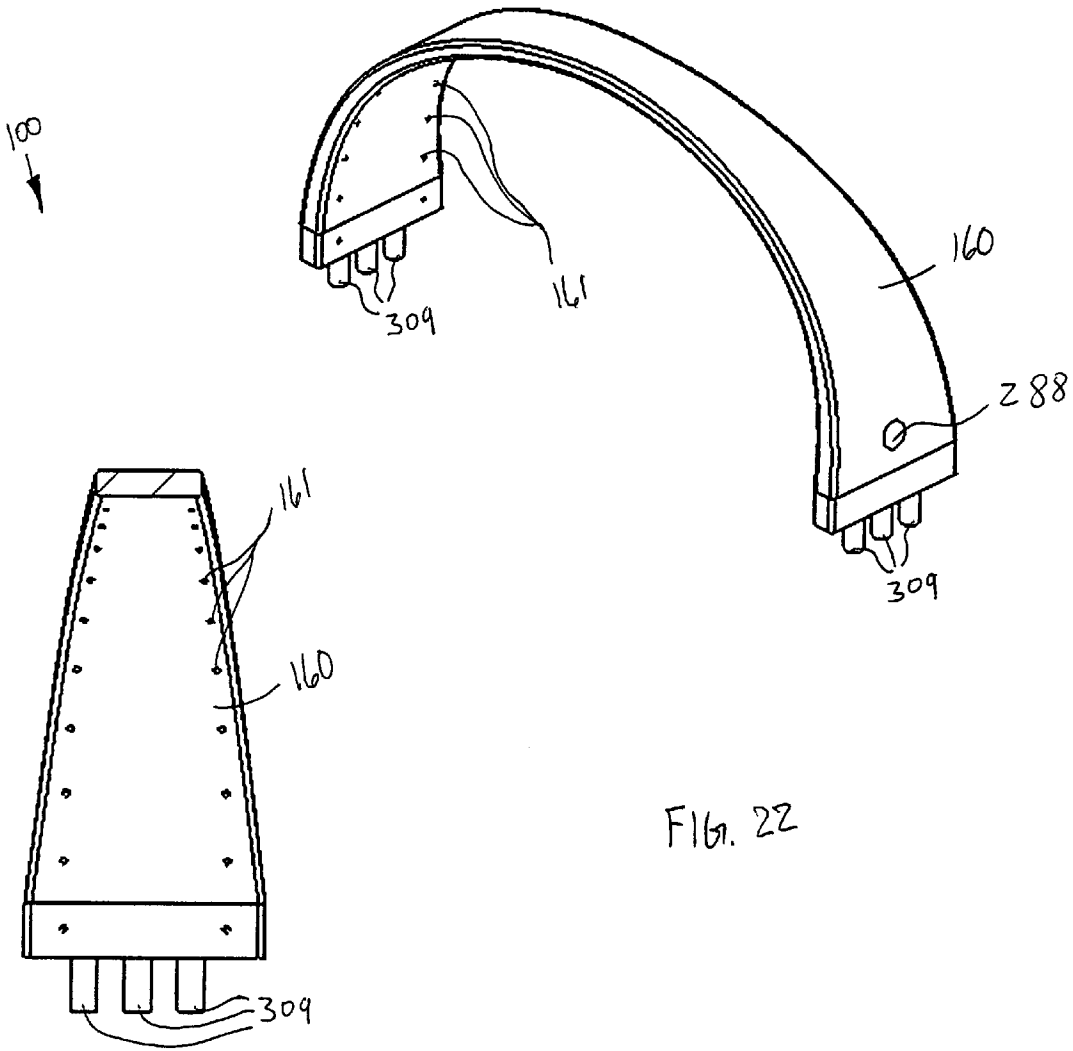
FIG. 22 is a perspective and cross sectional view of an arch respectively.

Referring to FIGS. 17, 18 and 21, the couplings 129 are outfitted with fittings 150 to receive plumbing connections and other accessories. The couplings 129 are designed to facilitate connections to and from water filtration and circulation systems that are available on the market today. These connections allow water to be effectively circulated and filtered. At the top of the coupling 129 is a rectangular passage 170 which meets the waterline. This fitting 170 allows for the connection of a Thru-wall skimmer. This provides filtration for surface debris. Another outlet used for filtration is located at the bottom of the coupling 129 and is used for water outlet/pump return. This outlet 210 connects to a regular 2½ inch plumbing but has a recessed cavity designed to house anti-entrapment safety drain covers (not shown) that are available on the market today. These advantageously prevent patrons from getting stuck to the pump return fittings. There are three threaded 2½" fittings 150 which are designed to house water jet nozzles (not shown) that will be used to provide a current to the lazy river 121. These fittings 150 can also be used to house waterproof lights that will illuminate the water at night.

Referring to FIGS. 17, 18, 21 and 22, at the top of both walls of the coupling 129 are three holes 152 which are used to anchor the coupling arches 160 via pegs 309. The outer most ends of both sides of the coupling 129 have vertical grooves 305 and attachment holes 304 for the attachment of supports 131, wheels 166, handles 165 and other necessary equipment.

Figure 31:
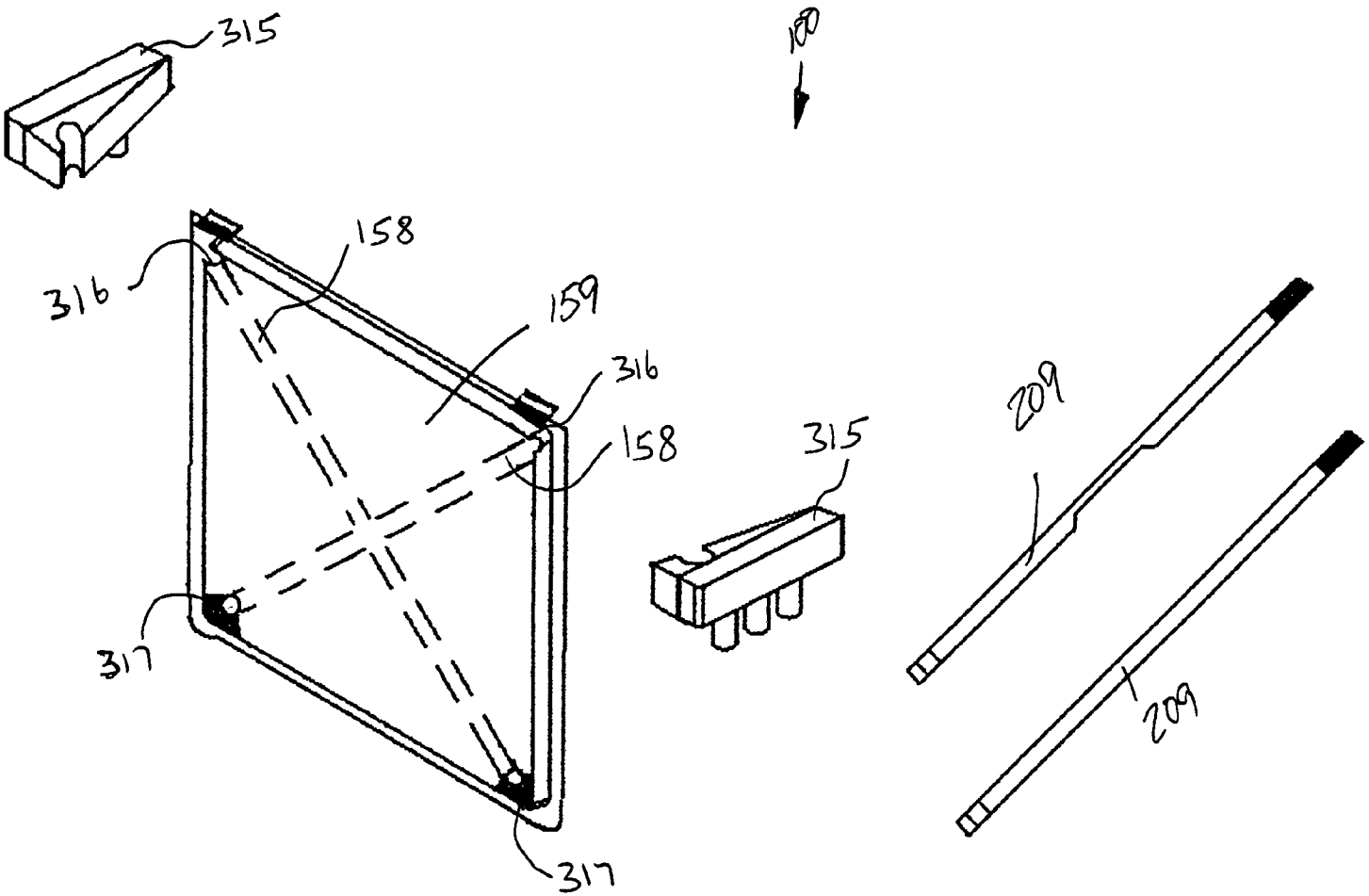
FIG. 31 is a perspective view of a rupture gate.

Referring to FIG. 31, each coupling 129 has a narrow slot 306 for the insertion of a rupture gate 159. A rupture gate 159 is used to provide an almost watertight separation of segments 128. The gates 159 are used in the event of an emergency or when water levels of pools are slightly different. Rupture gates 159 are supported using cross bars 209. Brackets 315 are provided with notches formed therein and help secure the cross bars 209 in place after being inserted into the slots 158. Notably, each slot 158 is provided with a beveled top opening 316 for guiding the cross bars 209 downwardly along the rupture gate 159. The bottom ends 317 of the slots 158 have spherical pockets formed therein for receiving the bottom ends of the cross bars 209 and maintaining same at substantially stable positions during operating conditions.

Referring to FIGS. 21, 22, 35 and 36, the coupling arches 160 are half circle arches that are attached to the couplings 129 to provide further enjoyment for users. It is outfitted with screw holes 161 to allow for the attachment of accessories such as water jets 262 that advantageously provide a waterfall effect for patrons traveling underneath it. The inlet port 288 is suitably sized and shaped for receiving a water supply line such that water continuously flows therethrough and sprays mist over patrons traveling in the lazy river. The screw holes 161 on the arches 160 allow for the attachment of decorations 147A such as coconut trees and dolphins, as well as lights and outdoor speakers. A plurality of pegs 309 extend downwardly from the ends of the arches 160 and fit into corresponding holes of the brackets. Notably, the arches 160 are preferably formed from light weight or otherwise hollow material for reducing tensional stress on the couplings during operating conditions.

Figure 25:
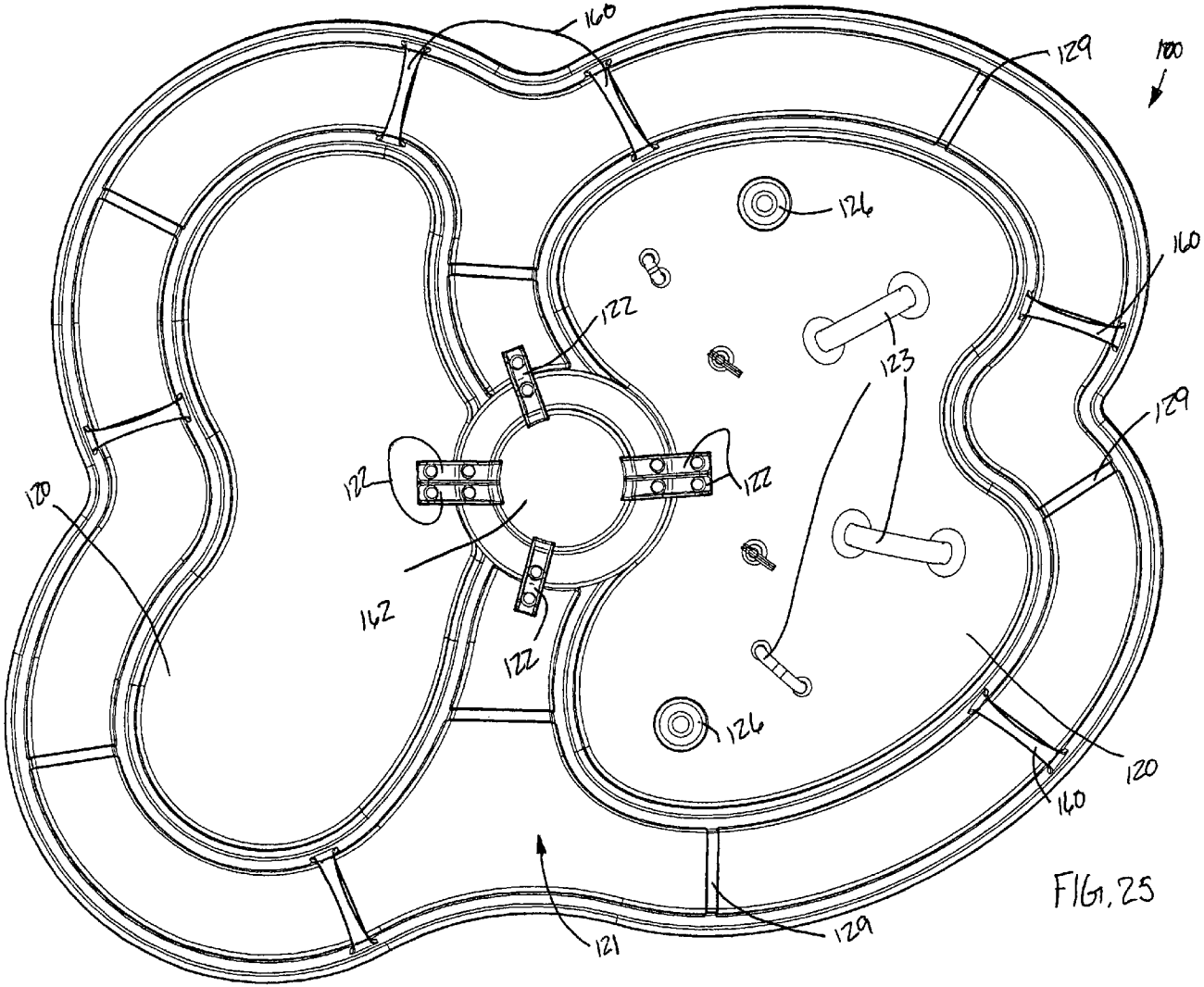
FIG. 25 is a top plan view of a water slide platform in accordance with the present invention.
Figure 26:
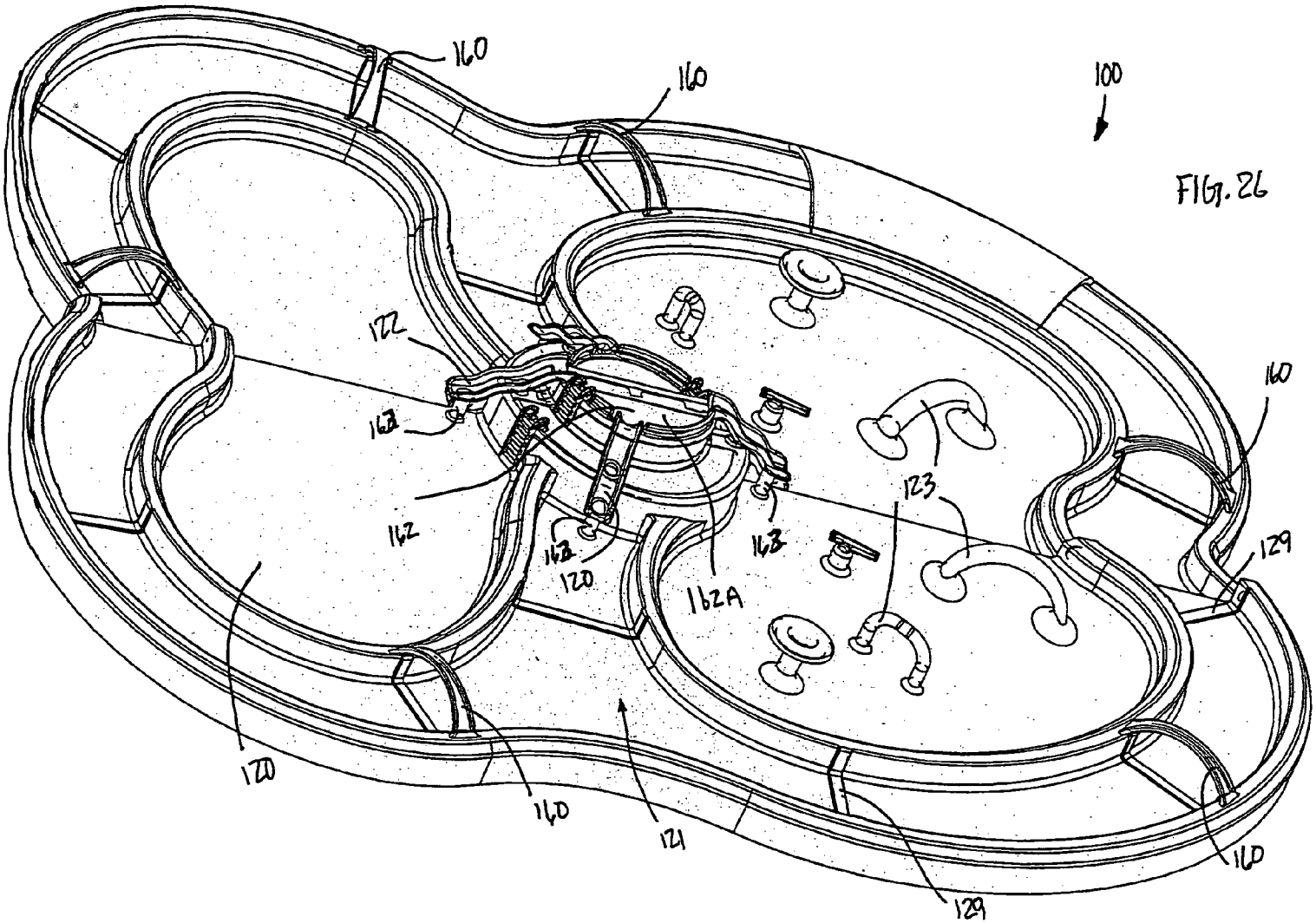
FIG. 26 is a perspective view of the assembly shown in FIG. 25.
Figure 27:
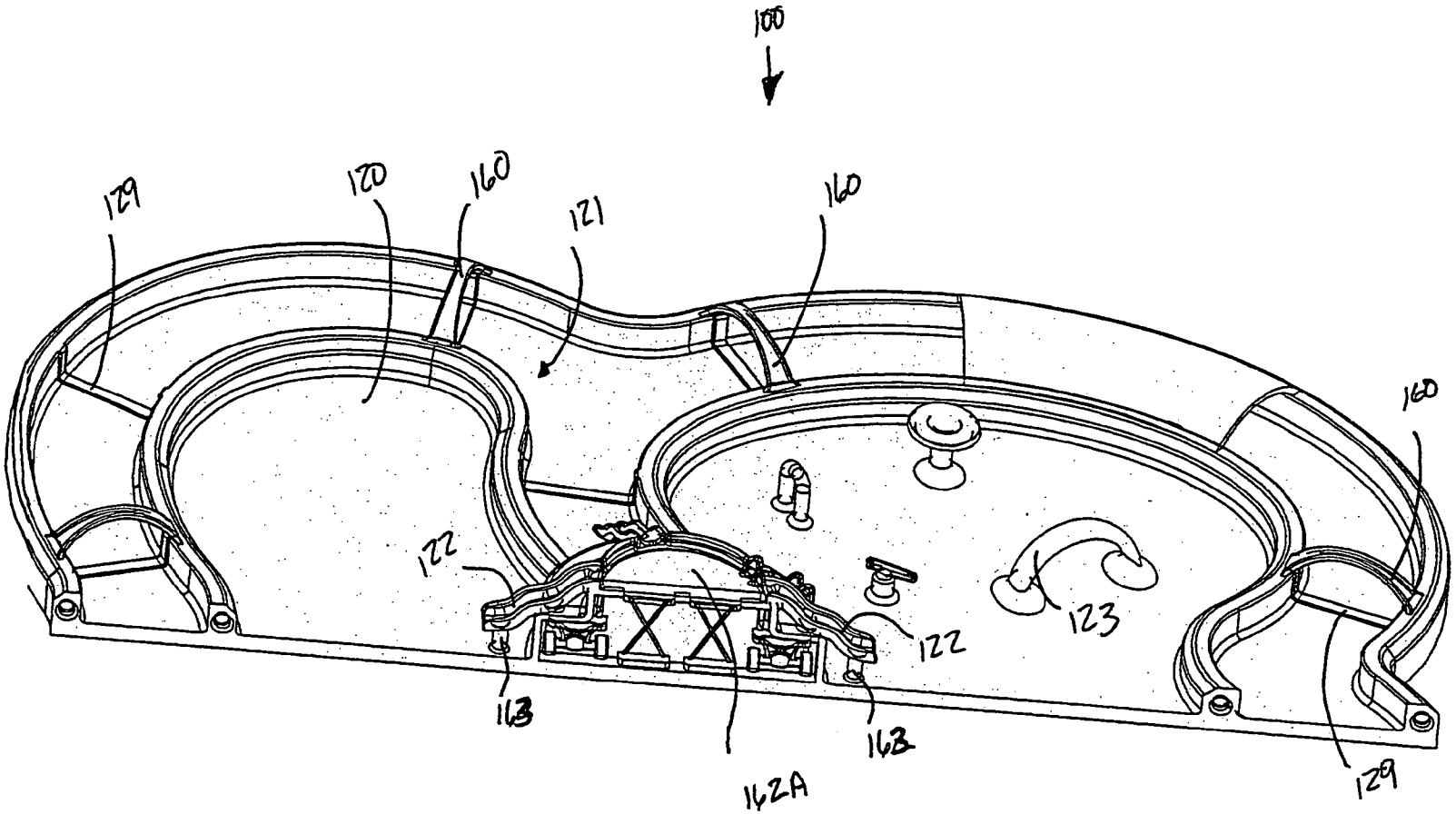
FIG. 27 is a cross sectional view of the assembly shown in FIG. 25.

Referring to FIGS. 25, 26 and 27, commercial size water parks 101 can be made by adding more segments 128 or by designing larger pool segments 128 using the same concepts discussed earlier. Larger waterslides 122 are facilitated by use of a water slide platform 162A, 162B. This is a specially designed platform 162 that is elevated to different levels by the use of hydraulics. The platforms 162 are designed to be secured to the back of a flat bed trailer to obtain varying heights for the platforms 162. These platforms 162 are stabilized with out riggers if necessary. The water slide platform 162 is arranged in a manner to have multiple heights and levels and to provide a sturdy and safe platform 162 to secure water slides 122 that are available on the market today. The water slides 122 are secured to the platform 162 using bolts, screws and other conventional methods.

Figure 28:
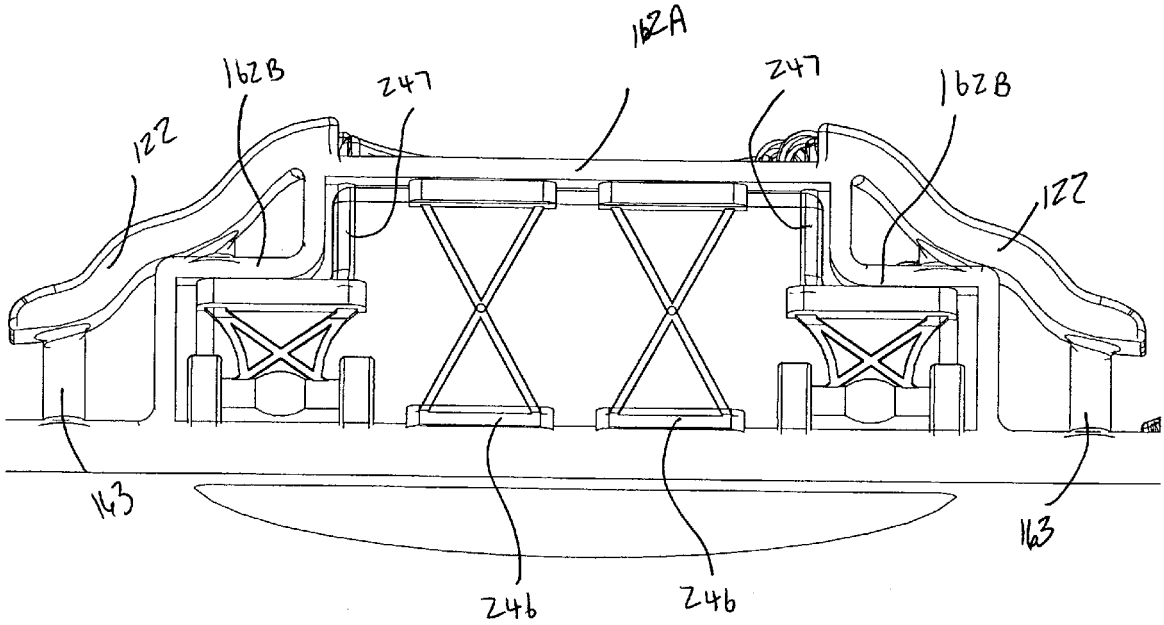
FIG. 28 is a side elevational view of a water slide platform.

Referring to FIGS. 28 and 37, anchor platforms 163 are used to support water slides 122 when they enter the pool 120. These platforms 163 are made in different sizes and shapes, which is crucial to provide a secure anchor point for water slides 122 when they enter the pool 120. They have cavities 164 that are filled with weighted products, such as sand, to keep them secured to the base of the pool 120. The anchor platforms 163 are also used to anchor the various structures and toys used in the interactive spray grounds 123. Hydraulically operable support members 246 are selectively adaptable along vertical paths for lifting and lowering the platform 162 as needed.

Figure 23:
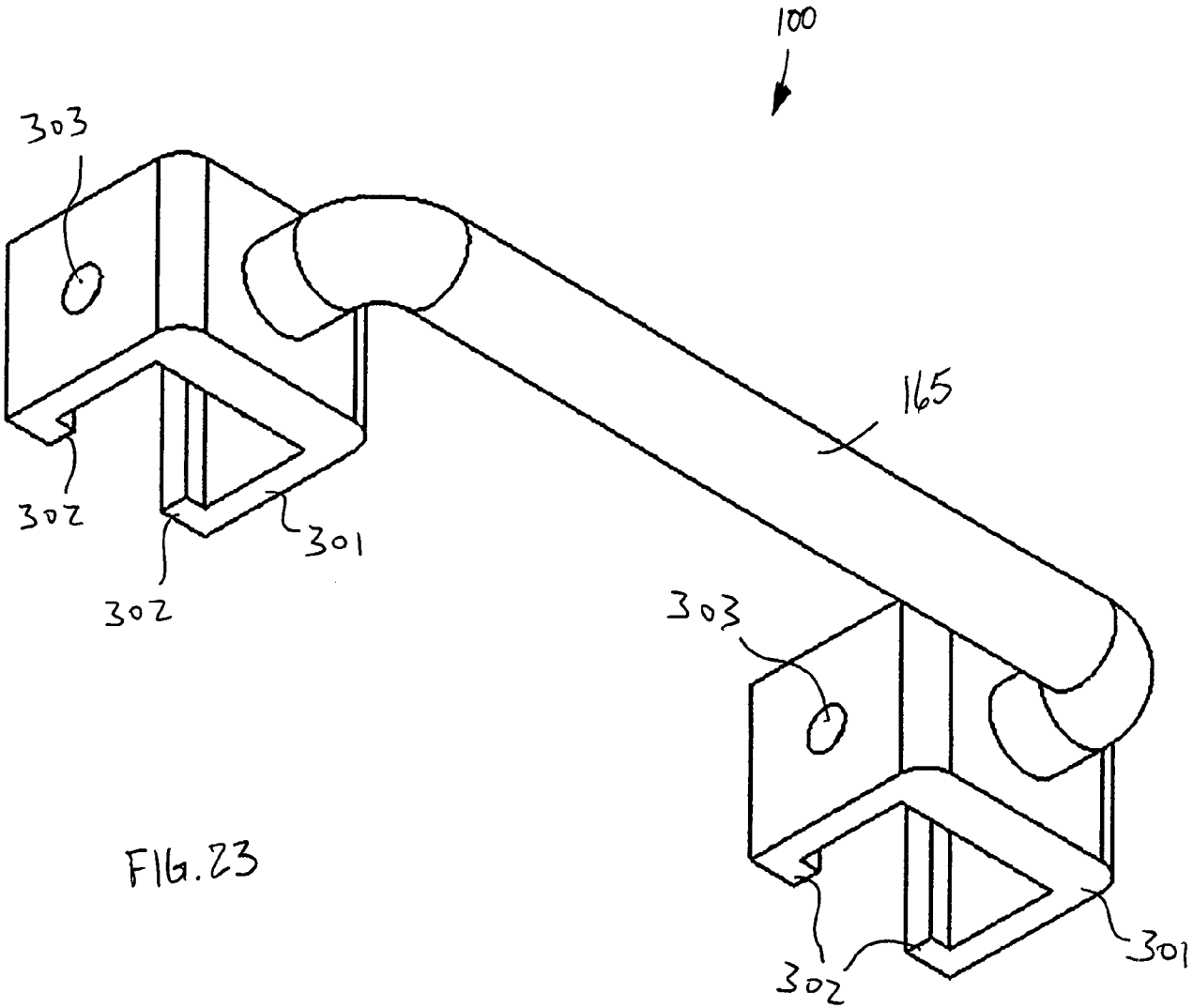
FIG. 23 is a perspective view of a coupling handle.
Figure 29:
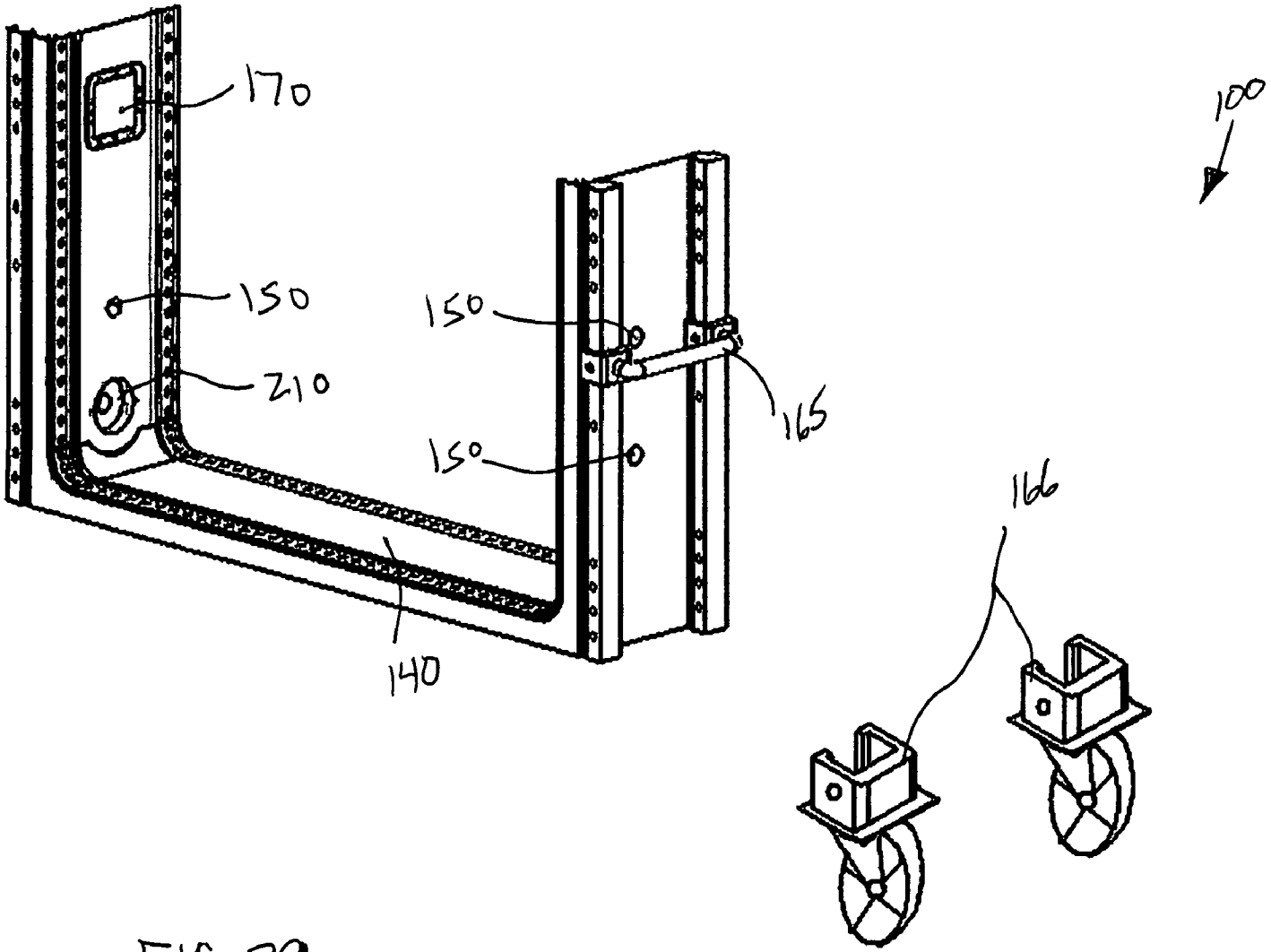
FIG. 29 is a perspective view of the coupling wheels.

Referring to FIGS. 23, 29 and 32, coupling handles 165 and coupling wheels 166 are used to transport the couplings 129 during setup. Each coupling handle includes a pair of outer U-shaped brackets 301 provided with inwardly extending shoulders 302 terminating apart from each other. Such shoulders 302 are suitably sized and shaped for slidably mating and fitting with notches 305 (shown in FIG. 17) formed along the vertical portions of the couplings 129 (as perhaps best shown in FIG. 17). Each bracket 301 has horizontally aligned holes formed therein. Such holes 303 become registered with associated ones of apertures 304 (shown in FIG. 21) formed in the couplings 129 for receiving a fastener therethrough. Benches 177 and stools 167, made of plastic, are outfitted with holes 168 that allow them to sink to the bottom of the pool 120. They can be used to store products as well as pool toys, and can be outfitted with a cushion or holes for an air jet. Some benches 177 have specially designed holes 172 for securing patio umbrellas. Of course, such handles 165, wheels 166, benches 177 and stools 167 can be produced in a variety of shapes and sizes, as is obvious to a person of ordinary skill in the art.

Figure 24:
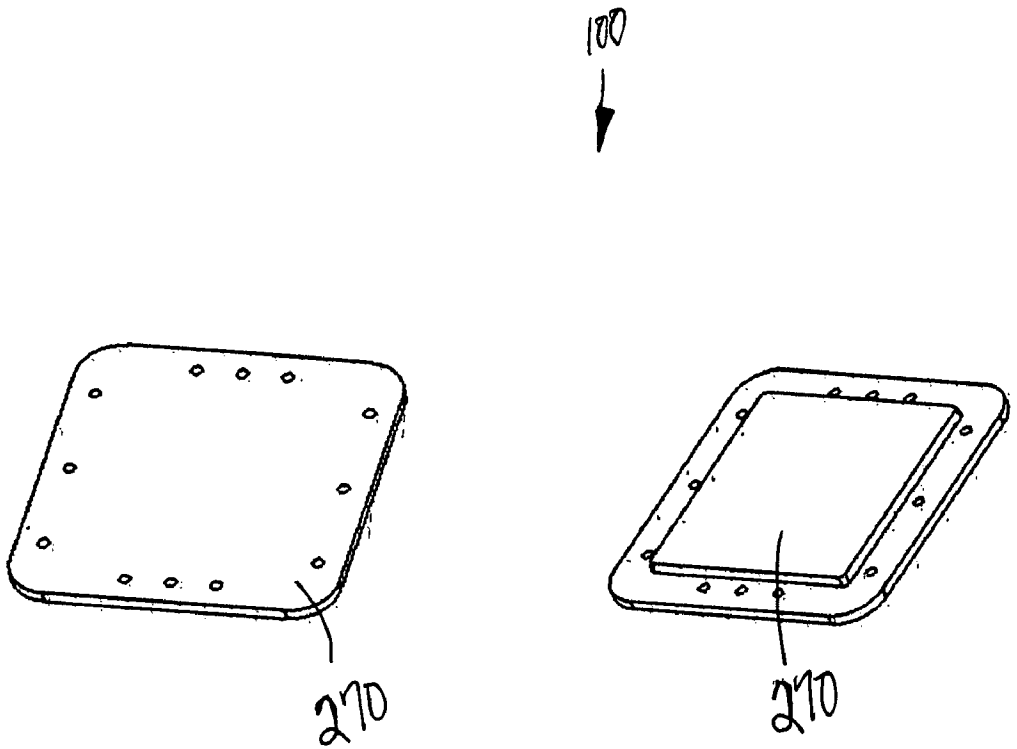
FIG. 24 is a top plan and bottom plan view of a skimmer plate respectively.
Figure 30:
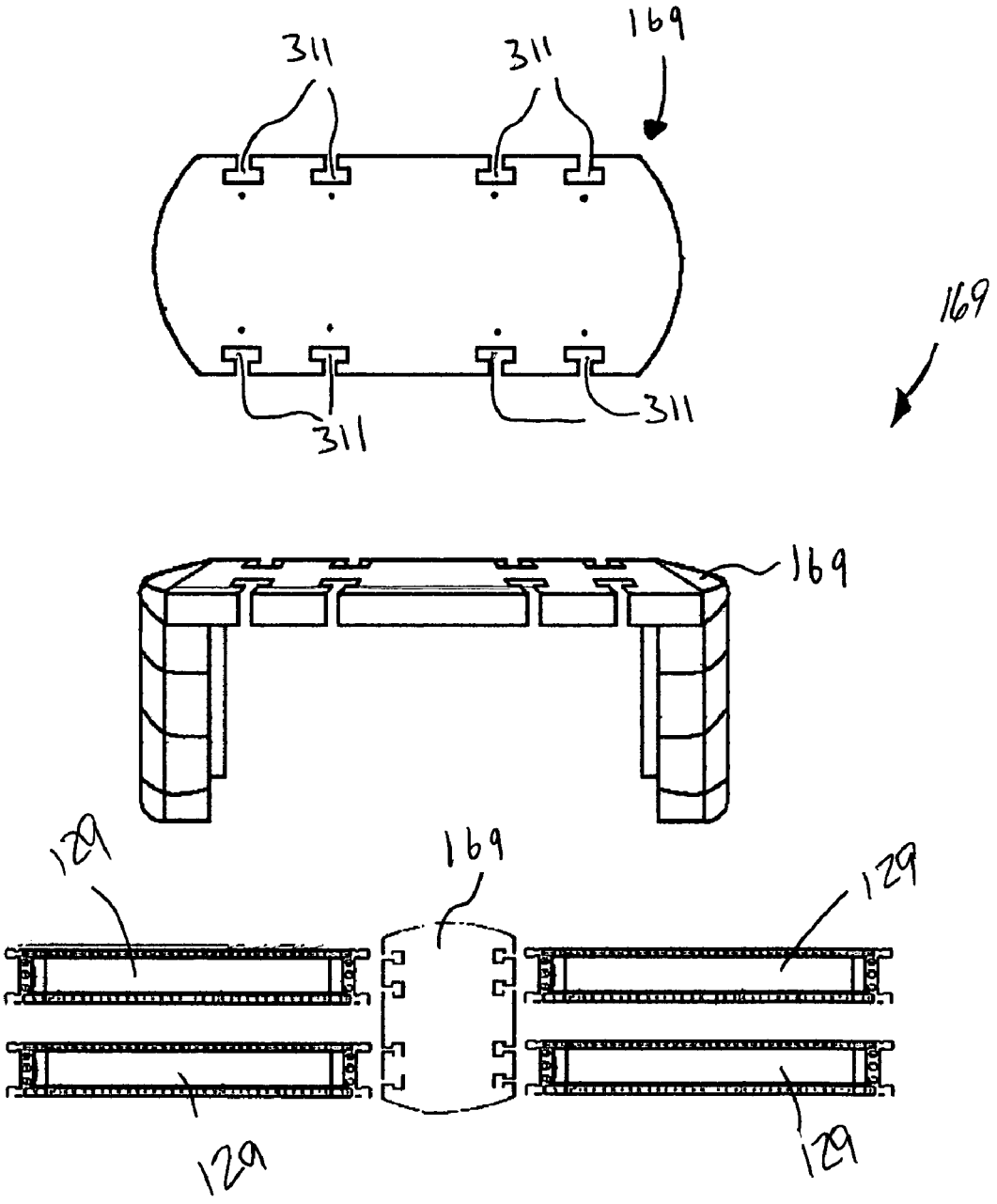
FIG. 30 is a perspective view of a coupling island.

Referring to FIGS. 24 and 30, a coupling island 169 is used for larger commercial water parks or when a much wider lazy river 121 is desired. FIG. 30 shows two top plan views and a side elevational view of the coupling island 160. A plurality of notches 311 are formed along outer edges of the island 169 for receiving couplings 129 therein. If a width of 16 ft is desired, two regular 7 ft couplings 129 can be connected together using a coupling island 169 to provide a lazy river 121 that is 16 ft wide. This prevents the need for making couplings 129 that are 16 ft wide. These coupling islands 169 can later be disguised to look like a rock, or a small island with a palm tree. Skimmer plates 270 close the skimmer fitting 170 for those segments 128 that are not outfitted with a Thru-wall skimmer.

Figure 33:
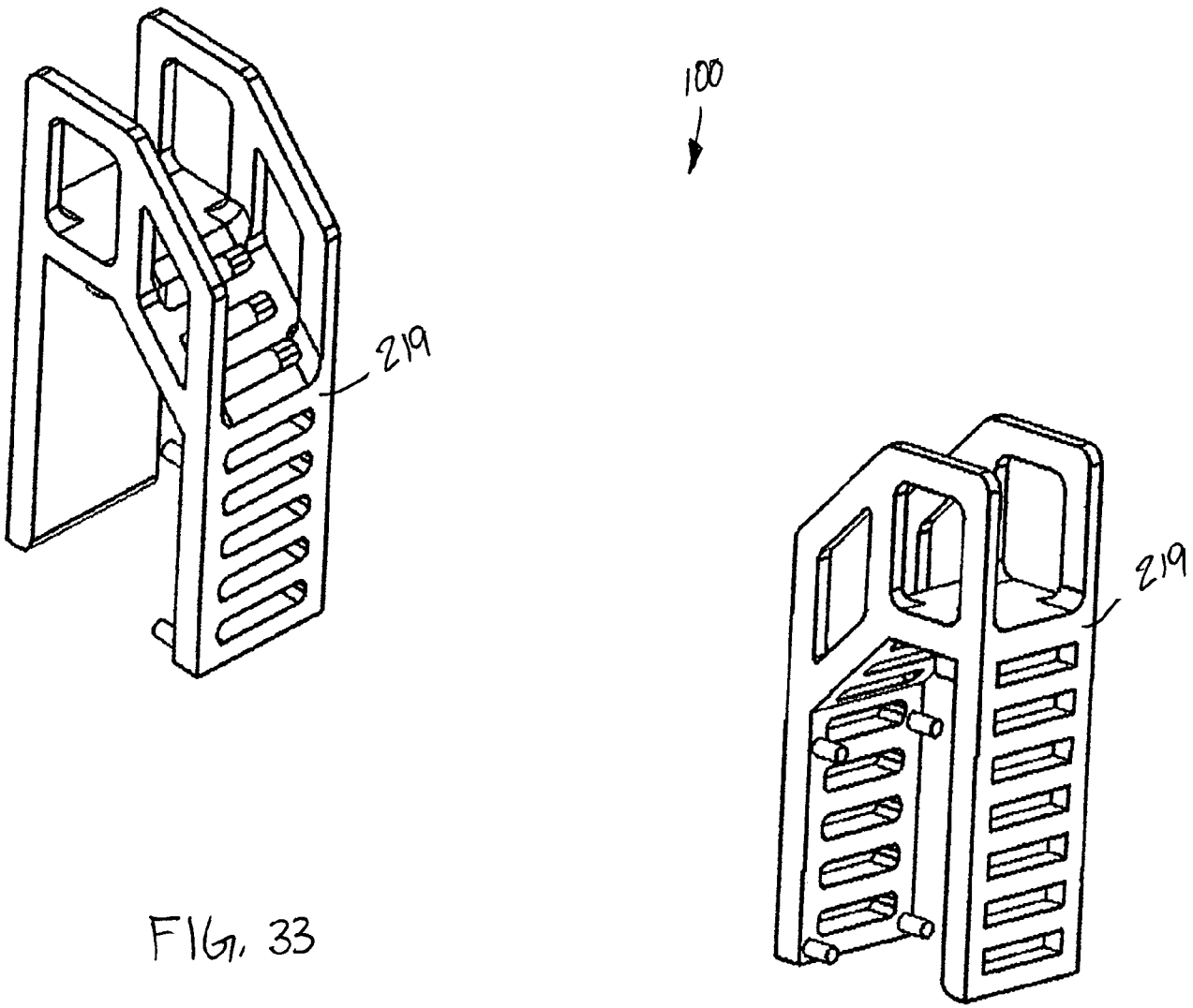
FIG. 33 is a perspective view of a pool ladder.

Referring to FIG. 33, ladders 219 are sized and shaped to fit the coupling walls, and are connected to various points along the water park 101 for allowing a user easy ingress and egress from the water park 101, and also allowing a user to access the various waterslides 122 throughout the water park 101.

Figure 34:
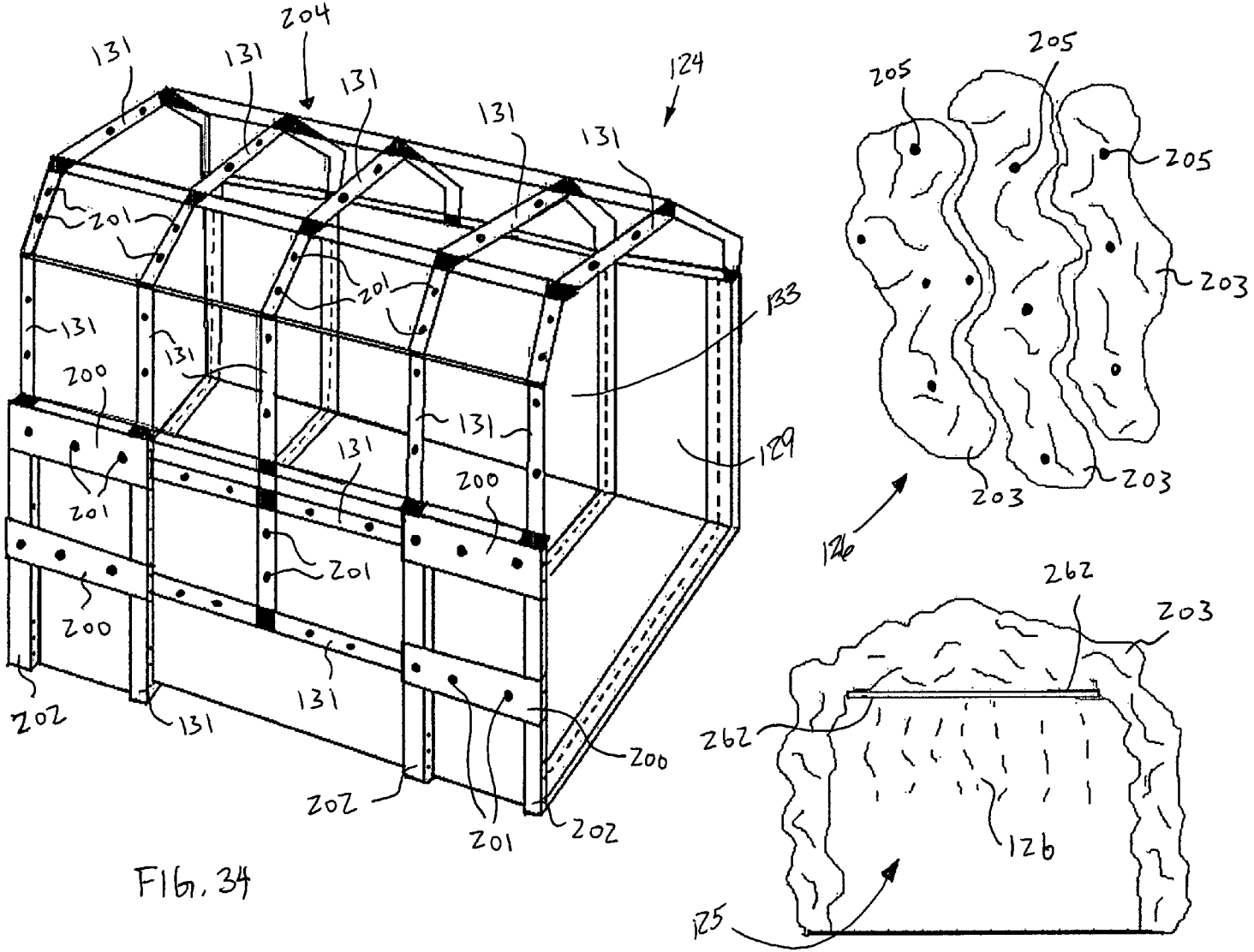
FIG. 34 is a perspective view of a rock cave and waterfalls.

Referring to FIG. 34, the couplings 129 can be outfitted with additional supports for defining a cave-like structure 124. This is accomplished through the use of metal 131 and plastic 200 supports that are attached to the coupling sleeves 202. These supports 131, 200 form a sturdy structural frame 204 that resembles a cave 124. These supports 131, 200 have heavy duty snap on buttons 201 that facilitate the addition of a decorative cave covering 203. The coverings 203 are made from synthetic material or rubber and they have rock shapes and patterns. They are divided into various segments and are assembled on the frame 204 like a puzzle. These decorative coverings 203 are also outfitted with buttons 205 that mate with those on the frame 204. Once assembled, the decorative coverings 203 enable the structure to resemble a rock cave 124. The entrance and exits of the cave 124 can be outfitted with spray jets 262 in order to simulate a waterfall 126 at the entrance and exits.

Figure 35:
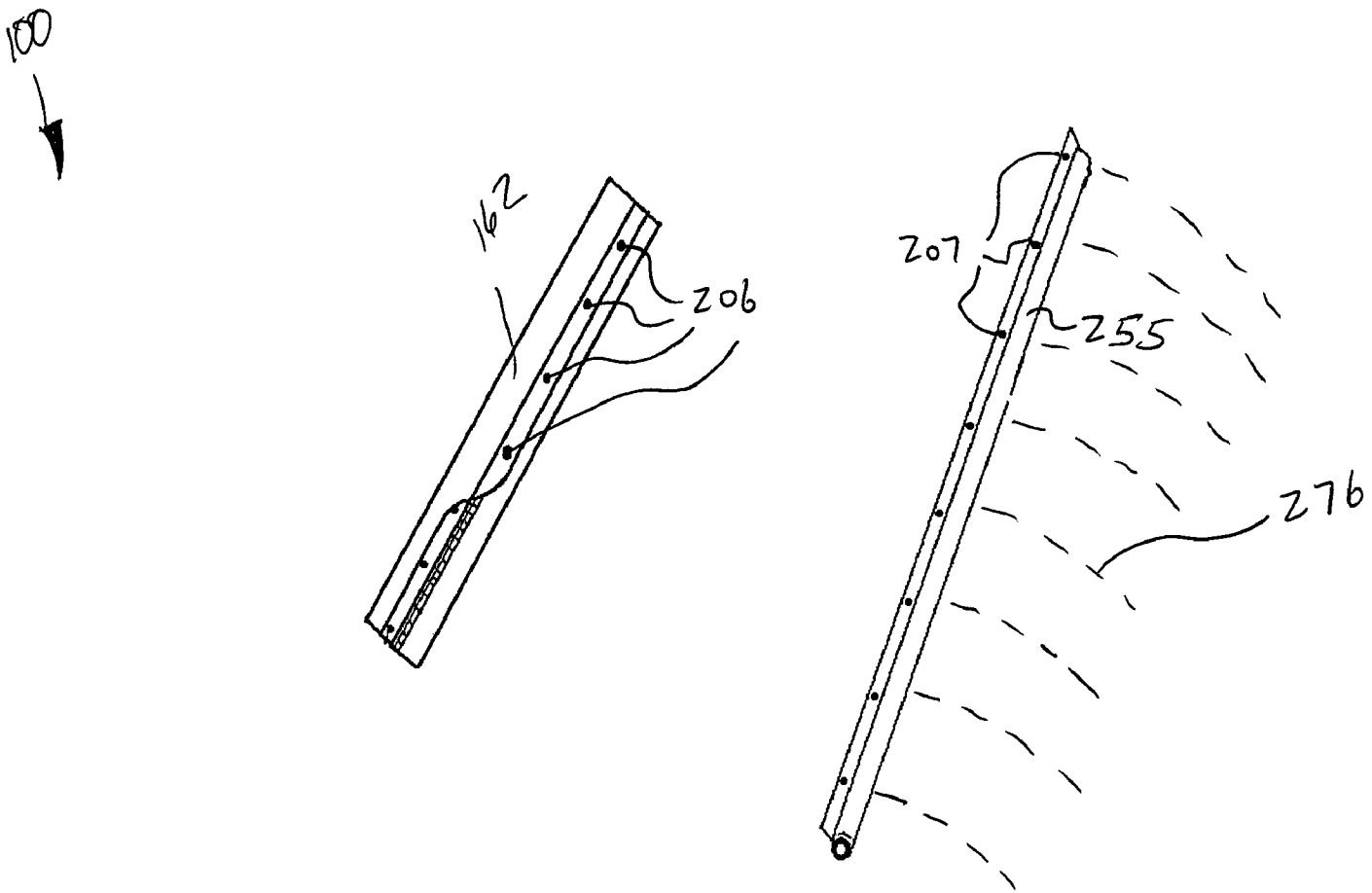
FIG. 35 is a perspective view of a water jets apparatus.

As perhaps best shown in FIG. 35, the assembly 100 includes a spray tunnel 276 created by water hose 255 placed on the banks 130 of the lazy river 121. The jets of the water hose 255 form an arch through which a user travels. Spray tunnels 276 are achieved by attaching a hose 255 or pipe 255 (shown in FIG. 35) outfitted with evenly spaced nozzles, to portions 299 (shown in FIG. 14) of the banks 130 of the lazy river 121. The banks 130 of the lazy river 121 are outfitted with buttons 206 that mate with buttons 207 of the spray tunnel hose 255. At the end of the spray tunnel hose 255 is a pipe fitting that enables a regular garden hose fitting to be connected to the spray tunnel pipe 255.

Figure 12:
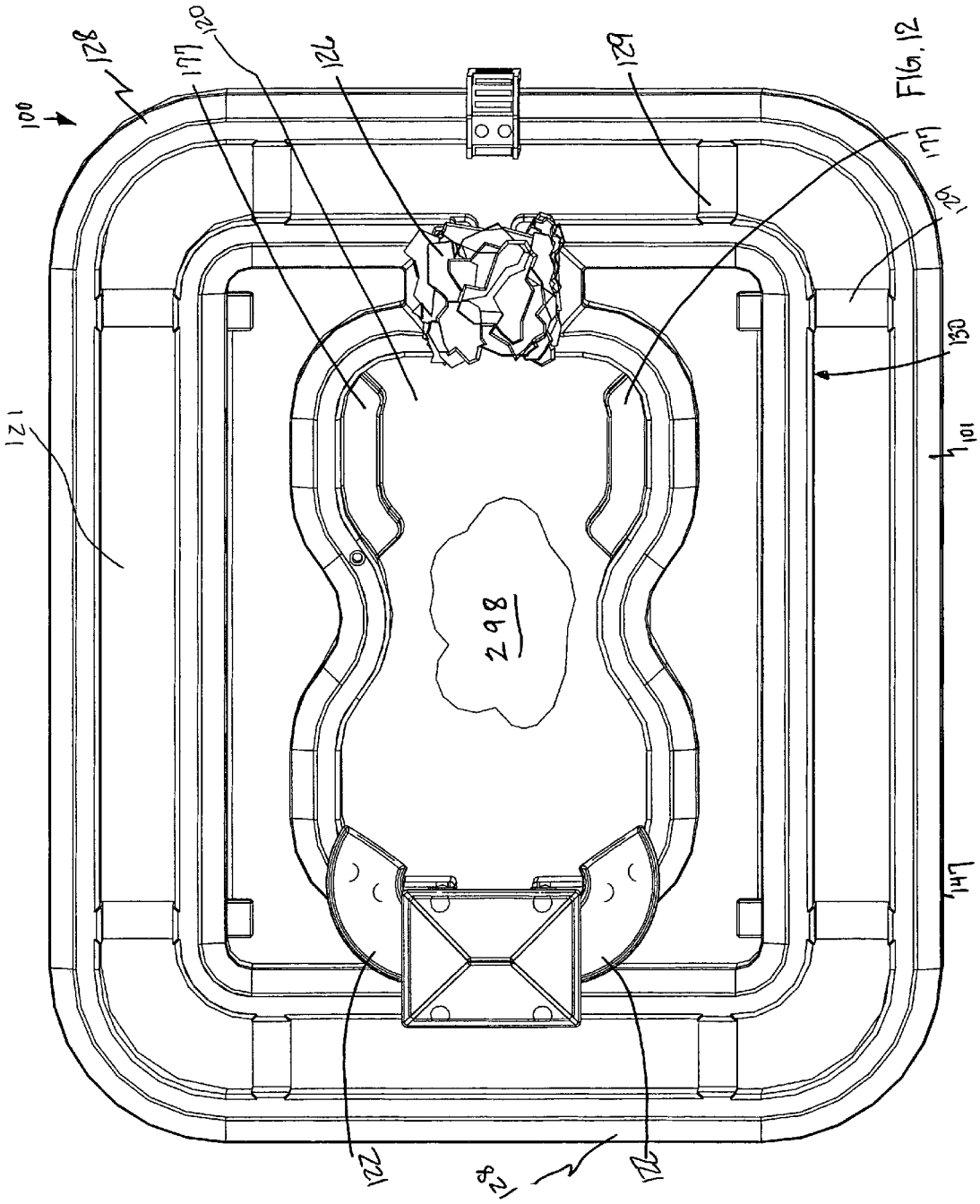
FIG. 12 is a top plan view of the assembly shown in FIG. 11.
Figure 13:
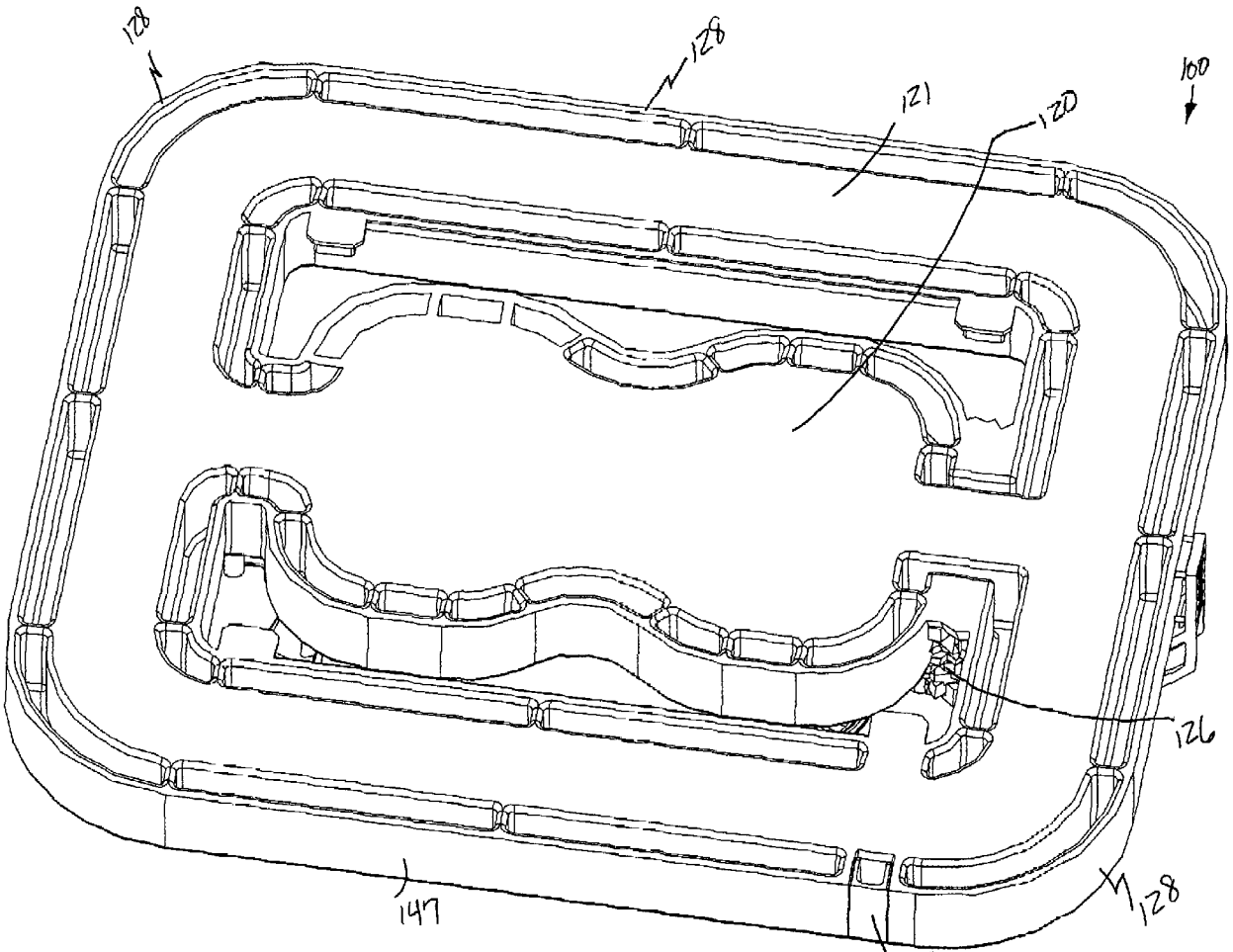
FIG. 13 is a bottom plan view of the assembly shown in FIG. 12.

Thus, an arched water fall is dissipated over the lazy river to provide a stimulating and soothing passage of spray mist or heavier rain fall, as desired over extended operating conditions. Spray tunnel hoses 255 can also be outfitted with small lights or LEDs to provide wonderful illumination at night. Also, as perhaps best shown in FIG. 12, the floor 298 of the main pool 120 can have photo-luminescent material that enables the company logo to glow in the dark. The main pool 120 also has an expandable floor that can be adjusted to various depths, as desired by the operator.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A modular water park assembly comprising:

a pool;

a lazy river in fluid communication with said pool;

a waterslide in fluid communication with one of said pool and said lazy river;

an interactive spray ground in fluid communication with one of said waterslide and said lazy river and said pool;

a cave operably positioned along said lazy river;

a tunnel operably positioned along said lazy river;

a waterfall in fluid communication with one of said pool and said lazy river and said waterslide and said spray ground;

a rapids stream in fluid communication with one of said pool and said lazy river and said waterslide and said spray ground and said waterfall; and a plurality of detachable modular segments joined together using a plurality of coupling devices for providing a water tight connection between said modular segments;

wherein each of said modular segments comprises a plurality of inflatable banks supported by a plurality of metal supports that resist outward forces of the water and keep said inflatable banks of said assembly erect;

a flexible padded flooring; and a liner operably connected to said padded flooring.

2. The modular water park assembly of claim 1, wherein one end of each of said modular segments further comprises:

a first rubber gasket having spaced holes formed therein, said gaskets being abutted against said couplings for providing a watertight seal, each of said couplings including a plurality of grooves formed on both sides of respectively inner walls thereof;

a second gasket being positioned about said grooves;

a plurality of third gaskets being lined along an upper and outermost perimeter of said groove for providing a watertight seal between said couplings and said modular segments respectively; and a plurality of brackets directly attached to said first gaskets respectively such that said first gaskets are fixedly secured to said coupling during operating conditions, said brackets including a plurality of vertical securing brackets and a plurality of corner securing brackets and a horizontal base securing bracket coupled to each of said modular segments respectively.

3. The modular water park assembly of claim 2, wherein each of said modular segments further comprises:

a coupling pad located behind said first gasket, said coupling pad having an inclined surface that smoothes out a plane disposed between one of said modular segments and an associated one of said couplings respectively, each said coupling pad covers a corresponding one of said base securing brackets and is fixedly maintained by a plurality of suction cups removably affixed to a center surface of said coupling.

4. The modular water park assembly of claim 3, wherein juxtaposed ones of said inflatable banks are separated by said padded flooring, each of said modular segments being provided with a plurality of inflation valves associated with a corresponding one of each of said inflatable banks respectively, each of inflation valves being in fluid connection via an associated air tube that extends through said inclined surface of said coupling pads respectively for allowing a user to simultaneously inflate said inflatable banks via one of said associated inflation valves respectively.

5. The modular water park assembly of claim 4, wherein said metal supports symmetrically extend along a curvature of associated ones of said modular segments and are attached to associated ones of said coupling segments respectively.

6. The modular water park assembly of claim 5, wherein selected ones of said brackets include a decorative covering for shielding said selected brackets from a visible line of sight, said decorative covering being affixed to an associated one of said inflatable banks of said modular segments via a fastener, said decorative covering being selectively inflatable along said inflatable banks of said assembly.

7. A modular water park assembly comprising:

a pool;

a lazy river in fluid communication with said pool;

a waterslide in fluid communication with one of said pool and said lazy river;

an interactive spray ground in fluid communication with one of said waterslide and said lazy river and said pool;

a cave operably positioned along said lazy river;

a tunnel operably positioned along said lazy river;

a waterfall in fluid communication with one of said pool and said lazy river and said waterslide and said spray ground;

a rapids stream in fluid communication with one of said pool and said lazy river and said waterslide and said spray ground and said waterfall; and a plurality of detachable modular segments joined together using a plurality of coupling devices for providing a water tight connection between said modular segments;

wherein each of said couplings comprises a plurality of fittings for receiving plumbing connections and for facilitating connections with an existing external water filtration and circulation systems;

a box matable with a waterline for connecting a thru-wall skimmer thereto;

an outlet formed within one of said couplings for returning water from the filtration and circulation systems;

a plurality of fittings formed within an inner wall of said coupling;

a plurality of water jet nozzles anchored to said fittings for providing a current direction to said lazy river; and a plurality of light illuminating sources anchored within said fittings.

8. The modular water park assembly of claim 7, wherein each of said couplings further includes:

a plurality of holes for anchoring a plurality of coupling arches, wherein outer most ends of said couplings have vertical grooves and attachment holes formed therein respectively for receiving a plurality of supports and a plurality of wheels and a plurality of handles and a plurality of waterfall decorations respectively.

9. The modular water park assembly of claim 7, wherein each of said couplings further comprises:

a slot formed therein for receiving a rupture gate, said rupture gate including a plurality cross bars supporting said rupture gate to an associated one of said couplings respectively.

10. The modular water park assembly of claim 8, wherein said coupling arches have semi-circular shapes and are attached to associated ones of said couplings, said coupling arches being outfitted with at least one accessories selected from a group including said water jets and a coconut tree and a dolphin and said light illuminating sources and an outdoor speaker respectively.

11. The modular water park assembly of claim 7, wherein said waterslide comprises:

a hydraulically operated water slide platform, each of said slide platforms being secured to a back of a flat bed trailer for varying a height of said platforms;

a plurality of out riggers operably coupled to said platforms for assisting an operator to adjust the height of said platforms;

a plurality of anchor platforms supporting a bottom end of said waterslide in said pool, each of said anchor platforms including a plurality of cavities filled with a predetermined volume of weighted products for maintaining said anchor platforms statically engaged with a base of the pool.

12. The modular water park assembly of claim 7, wherein selected ones of said couplings further comprise:

at least one coupling handle attached thereto; and at least one coupling wheel connected to an associated one of said couplings for transporting said the couplings.

13. The modular water park assembly of claim 7, further comprising:

at least one bench seated within said pool, said at least one bench including at least one of said air jets, and a patio umbrella attached thereto; and at least one ladder spaced along said assembly for allowing a user easy ingress and egress from said water park and further allowing a user to access said waterslides disposed throughout said water park.

* * * * *